US010202228B2

(12) United States Patent
Boersma et al.

(10) Patent No.: US 10,202,228 B2
(45) Date of Patent: Feb. 12, 2019

(54) CARTON WITH ASYMMETRICAL CORNERS

(71) Applicant: Graphic Packaging International, Inc., Atlanta, GA (US)

(72) Inventors: Harmen Boersma, Heerenveen (NL); Ana Gonzalez, Barcelona (ES); Esteve Rovira Porta, Barcelona (ES); Brian Smalley, Bristol (GB); Jon Thompson, Bristol (GB); Marie Zix, Avion (FR)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 15/286,963

(22) Filed: Oct. 6, 2016

(65) Prior Publication Data

US 2017/0101240 A1 Apr. 13, 2017

Related U.S. Application Data

(60) Provisional application No. 62/239,410, filed on Oct. 9, 2015.

(51) Int. Cl.
*B65D 71/36* (2006.01)
*B65D 5/02* (2006.01)

(52) U.S. Cl.
CPC ..... *B65D 71/36* (2013.01); *B65D 5/0209* (2013.01); *B65D 2571/0045* (2013.01);
(Continued)

(58) Field of Classification Search
CPC ..... B65D 71/36; B65D 5/248; B65D 5/22; B65D 5/241; B65D 5/30; B65D 5/62;
(Continued)

(56) References Cited

U.S. PATENT DOCUMENTS 926,758 A 7/1909 Miller
1,253,193 A 1/1918 Hill
(Continued)

FOREIGN PATENT DOCUMENTS

CA 27146 4/1965
CA 877792 8/1971
(Continued)

OTHER PUBLICATIONS

Graphic Packaging. Rounded Corner fridge pack. 2015 [earliest online date], [site visited Aug. 9, 2017]. Available from Internet, <URL:https://www.graphicpkgeurope.com/beverage/product-lines/fully-enclosed-carton-fed>.
(Continued)

*Primary Examiner* — Christopher Demeree
(74) *Attorney, Agent, or Firm* — Womble Bond Dickinson (US) LLP

(57) ABSTRACT

A carton for containing a plurality of articles. The carton comprises a plurality of panels that extends at least partially around an interior of the carton. The plurality of panels comprises a top panel, a bottom panel, a first side panel, and a second side panel. The carton comprises a first corner and a second corner at a closed end. The first corner has a first configuration and the second corner has a second configuration, the first configuration being different than the second configuration so that the first corner and second corner are asymmetrical.

42 Claims, 19 Drawing Sheets

(52) U.S. Cl.
CPC ..... *B65D 2571/0066* (2013.01); *B65D 2571/00141* (2013.01); *B65D 2571/00296* (2013.01); *B65D 2571/00302* (2013.01); *B65D 2571/00462* (2013.01); *B65D 2571/00543* (2013.01); *B65D 2571/00561* (2013.01); *B65D 2571/00574* (2013.01); *B65D 2571/00728* (2013.01)

(58) Field of Classification Search
CPC ..... B65D 5/68; B65D 65/403; B31B 3/26; B31B 3/60
USPC ..... 229/182.1, 164.1
See application file for complete search history.

(56) References Cited

U.S. PATENT DOCUMENTS 2,115,673 A 4/1938 Stompe
2,382,368 A 8/1945 Mitchell, Jr.
2,383,183 A 8/1945 Fishcher
2,586,301 A * 2/1952 Castle ..... B65D 5/18 206/193
2,594,376 A 4/1952 Arneson
2,702,144 A 2/1955 Forrer
2,797,856 A 7/1957 Jaeschke
2,800,224 A 7/1957 Walter et al.
2,810,506 A 10/1957 Kessler
2,819,506 A 10/1957 Kessler
2,868,433 A 1/1959 Anderson, Jr.
2,955,739 A 10/1960 Collura
3,112,856 A 12/1963 MacIntosh et al.
3,127,720 A 4/1964 Gentry et al.
3,166,235 A 1/1965 Schroeder
3,178,242 A 4/1965 Ellis et al.
3,204,814 A 9/1965 Mahon
3,204,815 A 9/1965 Weis
3,309,005 A 3/1967 Pilger
3,334,767 A 8/1967 Cornelius et al.
3,355,012 A 11/1967 Weiss
3,356,279 A 12/1967 Root
3,381,881 A 5/1968 Granz et al.
3,638,851 A 2/1972 Offer et al.
D230,955 S 3/1974 Katzenmeyer
3,807,624 A 4/1974 Funkhouser
3,828,926 A 8/1974 Rossi
3,886,901 A 6/1975 Zeitter
3,894,681 A 7/1975 Arneson et al.
3,904,036 A 9/1975 Forrer
3,912,156 A 10/1975 May
3,933,303 A 1/1976 Kirby, Jr.
3,994,432 A 11/1976 Kirby, Jr.
4,029,204 A 6/1977 Manizza
D244,993 S 7/1977 Drysdale
4,036,423 A 7/1977 Gordon
4,063,679 A 12/1977 Henry
4,096,985 A 6/1978 Wood
4,111,306 A 9/1978 Roccaforte
4,173,823 A 11/1979 Anderson et al.
4,216,861 A 8/1980 Oliff
4,318,474 A 3/1982 Hasegawa
4,328,923 A 5/1982 Graser
4,329,923 A 5/1982 Iida
4,331,289 A 5/1982 Killy
4,360,107 A 11/1982 Roccaforte
4,364,509 A 12/1982 Holley et al.
4,375,258 A 3/1983 Crayne et al.
4,378,905 A 4/1983 Roccaforte
4,382,505 A 5/1983 Sutherland et al.
4,396,143 A 8/1983 Killy
4,417,655 A 11/1983 Forbes, Jr.
4,418,864 A 12/1983 Nielsen
4,424,901 A 1/1984 Lanier
4,436,244 A 3/1984 Morris
4,440,340 A 4/1984 Bakx
4,470,503 A 9/1984 Stone
4,476,989 A 10/1984 Larsen
4,478,334 A 10/1984 Graser
4,498,619 A 2/1985 Roccaforte
4,508,258 A 4/1985 Graser
4,538,759 A 9/1985 Dutcher
4,545,485 A 10/1985 Oliff
4,546,914 A 10/1985 Roccaforte
4,567,341 A 1/1986 Brown
4,577,762 A 3/1986 Kuchenbecker
4,577,799 A 3/1986 Oliff
4,588,084 A 5/1986 Holley, Jr.
4,653,686 A 3/1987 Wood et al.
4,706,876 A 11/1987 Wilson
4,747,487 A 5/1988 Wood
4,747,534 A 5/1988 Marie
4,765,534 A 8/1988 Zion et al.
4,784,266 A 11/1988 Chaussadas
4,784,316 A 11/1988 Crouch
4,802,583 A 2/1989 Calvert et al.
4,830,267 A 5/1989 Wilson
4,875,586 A 10/1989 Chaussadas
4,890,440 A 1/1990 Romagnoli
D306,402 S 3/1990 Colla
4,949,845 A 8/1990 Dixon
D311,339 S 10/1990 Weed
4,966,324 A 10/1990 Steel
4,974,771 A 12/1990 Lavery
5,020,337 A 6/1991 Krieg
D318,235 S 7/1991 Weed
5,060,792 A 10/1991 Oliff
5,071,062 A 12/1991 Bradley et al.
5,072,876 A 12/1991 Wilson
5,094,359 A 3/1992 DeMars et al.
5,106,014 A 4/1992 Miller
5,118,032 A 6/1992 Geho
5,119,985 A 6/1992 Dawson et al.
5,137,211 A 8/1992 Summer et al.
5,197,598 A 3/1993 Stout et al.
5,221,041 A 6/1993 Stout et al.
5,222,658 A 6/1993 DeMaio et al.
5,234,102 A 8/1993 Schuster et al.
5,246,112 A 9/1993 Stout et al.
5,263,634 A 11/1993 Korine
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,320,277 A 6/1994 Stout et al.
5,328,030 A 7/1994 Sutherland
5,328,081 A 7/1994 Saulas
5,333,734 A 8/1994 Stout et al.
D350,480 S 9/1994 Sutherland
5,350,110 A 9/1994 Will
5,379,944 A 1/1995 Stout et al.
5,381,891 A 1/1995 Harris
5,385,234 A 1/1995 Stout et al.
5,395,044 A 3/1995 Stout
5,427,241 A 6/1995 Sutherland
5,458,234 A 10/1995 Harris
D364,344 S 11/1995 Shaw
5,472,090 A 12/1995 Sutherland
5,472,136 A 12/1995 Roccaforte
5,485,915 A 1/1996 Harris
5,495,727 A 3/1996 Strong et al.
5,505,372 A 4/1996 Edson et al.
5,524,756 A 6/1996 Sutherland
5,535,940 A 7/1996 Olds
5,551,556 A 9/1996 Sutherland
5,560,539 A 10/1996 Baxter
5,582,343 A 12/1996 Dalvey
D377,861 S 2/1997 Jacober
5,605,279 A 2/1997 Adamek
5,622,309 A 4/1997 Matsuda et al.
5,639,017 A 6/1997 Fogle
5,647,483 A 7/1997 Harris
5,664,683 A 9/1997 Brody
5,669,500 A 9/1997 Sutherland

(56) References Cited

U.S. PATENT DOCUMENTS 5,678,492 A 10/1997 Pinkstone et al.
5,690,213 A 11/1997 Matsumura
5,699,957 A 12/1997 Bin et al.
5,704,470 A 1/1998 Sutherland
5,738,273 A 4/1998 Auclair
5,739,273 A 4/1998 Engelman et al.
5,794,778 A 8/1998 Harris
5,794,811 A 8/1998 Walsh
5,806,755 A 9/1998 Correll
5,826,782 A 10/1998 Stout
5,826,783 A 10/1998 Stout
5,833,130 A 11/1998 Correll
5,848,749 A 12/1998 Ljungström
5,860,587 A 1/1999 Young
5,873,515 A 2/1999 Dunn et al.
5,875,961 A 3/1999 Stone et al.
5,878,946 A 3/1999 Frerot et al.
5,906,313 A 5/1999 Oliff
5,915,546 A 6/1999 Harrelson
5,921,398 A 7/1999 Carroll
5,924,559 A 7/1999 Carrel et al.
5,992,733 A 11/1999 Gomes
6,019,276 A 2/2000 Auclair
6,021,897 A 2/2000 Sutherland
6,065,590 A 5/2000 Spivey
D426,154 S 6/2000 De Baschmakoff
6,085,969 A 7/2000 Burgoyne
6,105,853 A 8/2000 Lamare
6,105,854 A 8/2000 Spivey et al.
6,109,512 A 8/2000 Morrison
6,112,977 A 9/2000 Sutherland et al.
6,129,266 A 10/2000 Oliff et al.
6,131,803 A 10/2000 Oliff et al.
6,155,480 A 12/2000 Botsford et al.
6,164,526 A 12/2000 Dalvey
6,170,741 B1 1/2001 Skolik et al.
6,176,419 B1 1/2001 Holley, Jr.
6,202,920 B1 3/2001 Auclair
6,206,277 B1 3/2001 Correll
6,227,367 B1 5/2001 Harrelson et al.
6,260,755 B1 7/2001 Bates et al.
6,290,122 B1 9/2001 Correll
6,302,320 B1 10/2001 Stout
D452,154 S 12/2001 Rhodes et al.
6,364,199 B1 4/2002 Rose
6,371,365 B1 4/2002 Doucette et al.
6,375,066 B1 4/2002 Ritter
6,409,077 B1 6/2002 Telesca et al.
6,425,520 B1 7/2002 Peterson
6,523,739 B2 2/2003 Heeley et al.
6,536,656 B2 3/2003 Auclair et al.
6,571,539 B2 6/2003 Gendre et al.
6,631,803 B2 10/2003 Rhodes et al.
6,715,639 B2 4/2004 Spivey
D489,609 S 5/2004 Holthaus
6,752,262 B1 6/2004 Boriani et al.
6,758,337 B2 7/2004 Chargueraud et al.
6,766,940 B2 7/2004 Negelen
6,834,793 B2 12/2004 Sutherland
6,848,573 B2 2/2005 Gould et al.
6,866,186 B2 3/2005 Fogle et al.
6,869,009 B2 3/2005 Sutherland et al.
6,899,221 B2 5/2005 Skolik et al.
6,905,066 B2 6/2005 Holley
6,926,193 B2 8/2005 Smalley
6,945,450 B2 9/2005 Rusnock
6,968,992 B2 11/2005 Schuster
D513,177 S 12/2005 Tachikawa
6,971,572 B2 12/2005 Ikeda
7,000,803 B2 2/2006 Miller
7,007,836 B2 3/2006 Smalley
7,070,045 B2 7/2006 Theelen
7,234,596 B2 6/2007 Lebras
7,237,674 B2 7/2007 Auclair
D549,575 S 8/2007 Pinkstone
D553,496 S 10/2007 Martuch et al.
7,296,731 B2 11/2007 Auclair et al.
D558,047 S 12/2007 Pinkstone
7,374,038 B2 5/2008 Smalley
7,380,701 B2 6/2008 Fogle et al.
7,416,109 B2 8/2008 Sutherland
7,427,010 B2 9/2008 Sutherland
D582,267 S 12/2008 Andre
7,472,791 B2 1/2009 Spivey, Sr.
7,546,924 B2 6/2009 Oliveira
7,571,807 B2 8/2009 DeBusk et al.
7,601,111 B2 10/2009 Sutherland et al.
7,665,653 B2 2/2010 Fitzwater
7,699,215 B2 4/2010 Spivey, Sr.
7,703,666 B2 4/2010 Hand et al.
7,743,944 B2 6/2010 Ho Fung et al.
7,743,968 B2 6/2010 Theelen
7,748,603 B2 7/2010 Fogle et al.
7,757,933 B2 7/2010 Dunn
7,762,450 B2 7/2010 Oliveira
7,766,219 B2 8/2010 Gomes et al.
7,793,779 B2 9/2010 Spivey, Sr. et al.
7,806,314 B2 10/2010 Sutherland
8,070,052 B2 12/2011 Spivey, Sr. et al.
D657,239 S 4/2012 Gavrilenkov
8,191,761 B2 6/2012 Brand
D670,999 S 11/2012 Stowe
8,376,214 B2 2/2013 Spivey, Sr. et al.
D684,042 S 6/2013 Betzig
8,459,533 B2 6/2013 Requena et al.
8,740,051 B2 6/2014 Gonzalez
8,955,736 B2 2/2015 Spivey, Sr. et al.
D737,135 S 8/2015 Mizutani
D747,868 S 1/2016 Steka
9,415,914 B2 8/2016 Holley, Jr.
9,487,320 B2 11/2016 Holley, Jr.
9,499,319 B2 11/2016 Schmal et al.
D781,143 S 3/2017 Holley, Jr.
2002/0070139 A1 6/2002 Bates
2002/0088820 A1 7/2002 Spivey
2002/0088821 A1 7/2002 Spivey et al.
2003/0192905 A1 10/2003 Spivey
2003/0213263 A1 11/2003 Woog
2004/0050917 A1 3/2004 Smalley
2004/0060972 A1 4/2004 Harrelson
2004/0074954 A1 4/2004 Fogle et al.
2004/0099558 A1 5/2004 Oliff et al.
2004/0164133 A1 8/2004 Harrelson
2004/0188277 A1 9/2004 Auclair
2004/0188300 A1* 9/2004 Sutherland ..... B65D 71/36 206/427
2004/0256445 A1 12/2004 Merzeau
2004/0262374 A1 12/2004 Chargueraud
2005/0056658 A1 3/2005 Spivey
2005/0087592 A1 4/2005 Schuster
2005/0167292 A1* 8/2005 Sutherland ..... B65D 71/36 206/170
2005/0167476 A1 8/2005 Ikeda
2005/0167478 A1 8/2005 Holley, Jr.
2005/0178687 A1 8/2005 Spivey, Sr.
2005/0178791 A1 8/2005 Miller
2006/0000881 A1 1/2006 Sutherland
2006/0071058 A1 4/2006 Spivey, Sr.
2006/0108406 A1 5/2006 Stewart et al.
2006/0169755 A1 8/2006 Spivey, Sr.
2006/0254942 A1 11/2006 Cargile, Jr.
2006/0273143 A1 12/2006 Finch
2007/0039846 A1 2/2007 Spivey, Sr.
2007/0051781 A1 3/2007 Holley, Jr.
2007/0108261 A1 5/2007 Schuster
2007/0137222 A1 6/2007 Kastanek et al.
2007/0164091 A1 7/2007 Fogle et al.
2007/0181658 A1 8/2007 Sutherland
2007/0205255 A1 9/2007 Dunn
2007/0284424 A1 12/2007 Holley
2007/0295789 A1 12/2007 Ho Fung
2008/0083820 A1 4/2008 Walling et al.
2008/0099544 A1 5/2008 Skolik
2008/0119344 A1 5/2008 Sutherland et al.

(56) References Cited

U.S. PATENT DOCUMENTS

| | | | |
|---|---|---|---|
| 2009/0236408 | A1 | 9/2009 | Spivey, Sr. |
| 2009/0255983 | A1 | 10/2009 | De Paula et al. |
| 2010/0108747 | A1 | 5/2010 | Brand |
| 2010/0213249 | A1 | 8/2010 | Requena et al. |
| 2010/0270367 | A1 | 10/2010 | Brandenburger |
| 2011/0095075 | A1 | 4/2011 | Pinkstone |
| 2012/0279897 | A1 | 11/2012 | Schmal et al. |
| 2013/0214036 | A1 | 8/2013 | Spivey, Sr. et al. |
| 2013/0220873 | A1 | 8/2013 | Holley, Jr. |
| 2013/0284628 | A1 | 10/2013 | Moncrief et al. |
| 2014/0260095 | A1 | 9/2014 | Oliveira |
| 2014/0305826 | A1 | 10/2014 | Holley, Jr. |
| 2015/0001116 | A1 | 1/2015 | Schmal et al. |
| 2015/0151888 | A1 | 6/2015 | Fitzwater et al. |
| 2017/0101240 | A1 | 4/2017 | Boersma |

FOREIGN PATENT DOCUMENTS

| | | | |
|---|---|---|---|
| CA | 2 160 145 | | 9/1995 |
| CA | 118620 | | 12/2007 |
| CA | 122012 | | 7/2008 |
| CA | 126100 | | 12/2008 |
| CA | 129892 | | 12/2009 |
| CA | 131063 | | 3/2010 |
| CA | 131481 | | 3/2010 |
| CA | 132220 | | 5/2010 |
| CA | 133757 | | 9/2010 |
| CA | 136756 | | 9/2010 |
| CA | 166826 | | 10/2016 |
| CA | 169768 | | 3/2017 |
| CA | 171618 | | 7/2017 |
| DE | 1 192 099 | B | 4/1965 |
| DE | 85 14 718.4 | | 6/1985 |
| DE | 93 20 302 | | 5/1994 |
| DE | 295 04 256 | U1 | 5/1995 |
| DE | 296 07 374 | | 4/1996 |
| DE | 201 12 228 | | 11/2002 |
| DE | 20 2004 018 649 | | 4/2005 |
| EP | 0 341 089 | | 11/1989 |
| EP | 0 412 226 | | 2/1991 |
| EP | 0 473 266 | | 3/1992 |
| EP | 0 475 147 | A1 | 3/1992 |
| EP | 1 260 448 | A1 | 11/2002 |
| EP | 1 262 417 | A2 | 12/2002 |
| EP | 1 518 792 | | 3/2005 |
| EP | 1 612 157 | | 1/2006 |
| EP | 1 661 813 | A1 | 5/2006 |
| FR | 1 494 239 | | 9/1967 |
| FR | 2.163.317 | | 7/1973 |
| FR | 2 163 317 | A1 | 7/1973 |
| FR | 2 549 010 | A1 | 1/1985 |
| FR | 2 579 175 | | 9/1986 |
| FR | 2 581 970 | A1 | 11/1986 |
| GB | 1 317 667 | | 5/1973 |
| JP | 06-32320 | | 4/1994 |
| JP | 8-503187 | | 4/1996 |
| JP | 2005-507831 | | 3/2005 |
| KR | 20-0356729 | | 7/2004 |
| WO | WO 94/10047 | | 5/1994 |
| WO | WO 96/27538 | | 9/1996 |
| WO | WO 96/29260 | A1 | 9/1996 |
| WO | WO 98/39220 | A1 | 9/1998 |
| WO | WO 99/28207 | | 6/1999 |
| WO | WO 99/64301 | A1 | 12/1999 |
| WO | WO 00/78618 | | 12/2000 |
| WO | WO 01/66434 | | 9/2001 |
| WO | WO 02/30785 | A1 | 4/2002 |
| WO | WO 03/037742 | | 5/2003 |
| WO | WO 03/082686 | A1 | 10/2003 |
| WO | WO 2004/043790 | A2 | 5/2004 |
| WO | WO 2005/080218 | | 9/2005 |
| WO | WO 2005/123532 | | 12/2005 |
| WO | WO 2007/089282 | | 8/2007 |
| WO | WO 2010/014438 | | 2/2010 |
| WO | WO 2013/177072 | A1 | 11/2013 |
| WO | WO 2014/186259 | A1 | 11/2014 |
| WO | WO 2016/069534 | A1 | 5/2016 |
| WO | WO 2016/099969 | A1 | 6/2016 |

OTHER PUBLICATIONS

Deline Box and Display. Produce Packaging. 2017 [earliest online date], [site visited Aug. 9, 2017]. Available from Internet, <URL:http://www.delinebox.com/success-stories/produce>.

European Search Report for EP 16 19 3052 dated Jan. 30, 2017.

European Search Report for EP 17 19 6117 dated Jan. 9, 2018.

Office Action for CA 173288 dated Mar. 20, 2018.

Office Action for CA 178318 dated Mar. 20, 2018.

Office Action for CA 178319 dated Mar. 20, 2018.

Office Action for CA 178320 dated Mar. 20, 2018.

* cited by examiner

CARTON WITH ASYMMETRICAL CORNERS

CROSS-REFERENCE TO RELATED APPLICATION

The present application claims the benefit of U.S. Provisional Patent Application No. 62/239,410, filed on Oct. 9, 2015.

INCORPORATION BY REFERENCE

The disclosure of U.S. Provisional Patent Application No. 62/239,410, filed Oct. 9, 2015, is hereby incorporated by reference for all purposes as if presented herein it its entirety.

BACKGROUND OF THE DISCLOSURE

The present disclosure generally relates to cartons for holding containers. More specifically, the present disclosure relates to a carton having asymmetrical corners.

SUMMARY OF THE DISCLOSURE

In one aspect, the present disclosure is generally directed to a carton for containing a plurality of articles. The carton comprises a plurality of panels that extends at least partially around an interior of the carton. The plurality of panels comprises a top panel, a bottom panel, a first side panel, and a second side panel. The carton comprises a first corner and a second corner at a closed end. The first corner has a first configuration and the second corner has a second configuration, the first configuration being different than the second configuration so that the first corner and second corner are asymmetrical.

In another aspect, the disclosure is generally directed to a blank for forming a carton.

In another aspect, the disclosure is generally directed to a method of assembling a carton.

According to an exemplary embodiment, the present disclosure is generally directed to a carton for holding a plurality of containers. The carton comprises a plurality of panels that extends at least partially around an interior of the carton. The plurality of panels comprises a bottom panel, a first side panel, a second side panel, and a top panel. A plurality of end flaps is respectively foldably connected to respective panels of the plurality of panels. The plurality of end flaps is at least partially overlapped to form a closed end of the carton. The end flaps comprise a first side end flap foldably connected to the first side panel and a second side end flap foldably connected to the second side panel. The closed end comprises a first corner adjacent the first side panel and a second corner adjacent the second side panel. The first corner having a first shape and the second corner having a second shape. The first shape is different than the second shape such that the first corner and the second corner are asymmetrical.

In another aspect, the present disclosure is generally directed to a blank for forming a carton for holding a plurality of containers. The blank comprises a plurality of panels comprising a bottom panel, a first side panel, a second side panel, and a top panel. A plurality of end flaps is respectively foldably connected to respective panels of the plurality of panels. The plurality of end flaps is for being at least partially overlapped to form a closed end of the carton formed from the blank. The end flaps comprise a first side end flap foldably connected to the first side panel and a second side end flap foldably connected to the second side panel. The first corner features are for forming a first corner adjacent first side panel at the closed end and second corner features are for forming a second corner adjacent the second side panel at the closed end. The first corner having a first shape and the second corner having a second shape. The first shape is different than the second shape such that the first corner and the second corner are asymmetrical.

In another aspect, the present disclosure is generally directed to a method of forming a carton for holding a plurality of articles. The method comprises obtaining a blank having a plurality of panels comprising a bottom panel, a first side panel, a second side panel, and a top panel, and a plurality of end flaps respectively foldably connected to respective panels of the plurality of panels. The plurality of end flaps comprises a first side end flap foldably connected to the first side panel and a second side end flap foldably connected to the second side panel. The blank includes first corner features and second corner features. The method comprises closing the end by at least partially overlapping the plurality of end flaps to form a closed end of the carton. The closing the end comprises forming the first corner by positioning the first corner features of the blank. The first corner being adjacent the first side panel at the closed end. The method comprises and forming the second corner by positioning the second corner features of the blank. The second corner features being adjacent the second side panel at the closed end. The first corner having a first shape and the second corner having a second shape, the first shape is different than the second shape such that the first corner and the second corner are asymmetrical.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present invention generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, glass; aluminum and/or other metals; plastics such as PET, LDPE, LLDPE, HDPE, PP, PS, PVC, EVOH, and Nylon; and the like, or any combination thereof.

Cartons according to the present invention can accommodate articles of any shape. For the purpose of illustration and not for the purpose of limiting the scope of the invention, the following detailed description describes beverage containers (e.g., aluminum beverage cans) as disposed within the carton embodiments. In this specification, the terms "lower," "bottom," "upper" and "top" indicate orientations determined in relation to fully erected and upright cartons.

Figure 1A:
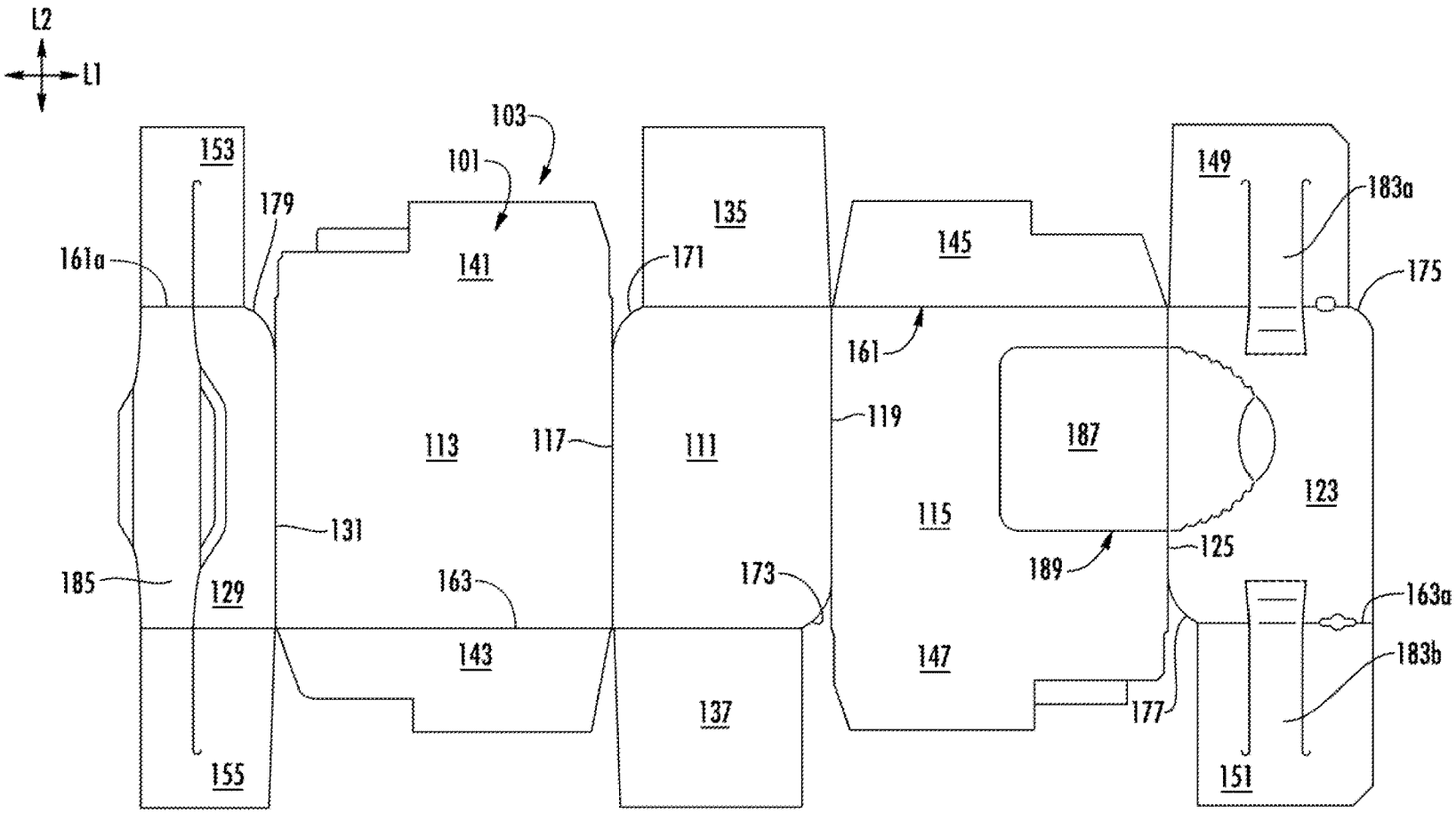
FIG. 1A is a plan view of a blank according to a first embodiment of the present disclosure.

FIG. 1A is a plan view of the interior side 101 of a blank, generally indicated at 103, used to form a carton 105 (FIG. 1C) according to a first exemplary embodiment of the disclosure. The carton 105 can be used to house a plurality of articles such as beverage containers C (FIG. 1E) that are typically beverage cans or beverage bottles, but can be any suitable container or article. In one embodiment, the carton 105 has four corners 106, 108, 110, 112 defined between top panels 123, 129 and a bottom panel 117. The corners 106, 108 are located at a first end 167 of the carton 105 and the corners 110, 112 are located at a second end 169 of the carton. In the first embodiment, the corners 106, 108 at the first end 167 are asymmetrical in that the first corner 106 has a first configuration (e.g., rounded) and the second corner 108 has a second configuration (e.g., orthogonal or square). The third corner 110 and the fourth corner 112 at the second end 169 are also asymmetrical with the third corner 110 having a corresponding shape as the second corner 108 (e.g., orthogonal or square) and the fourth corner 112 having a corresponding shape as the first corner 106 (e.g., rounded). As will be described herein the corners 106, 108, 110, 112 can have other shapes or configurations without departing from the disclosure. In one illustrated embodiment, the carton 105 is sized to house six containers in one layer in a 2×3 arrangement, but it is understood that the carton may be sized and shaped to hold containers of a different or same quantity in a single layer, more than one layer, and/or in different row/column arrangements (e.g., 1×6, 3×4, 3×6, 3×5×2, 2×6, 5×6, 2×6×2, 3×4×2, 2×9, etc.) without departing from the disclosure.

Figure 1B:
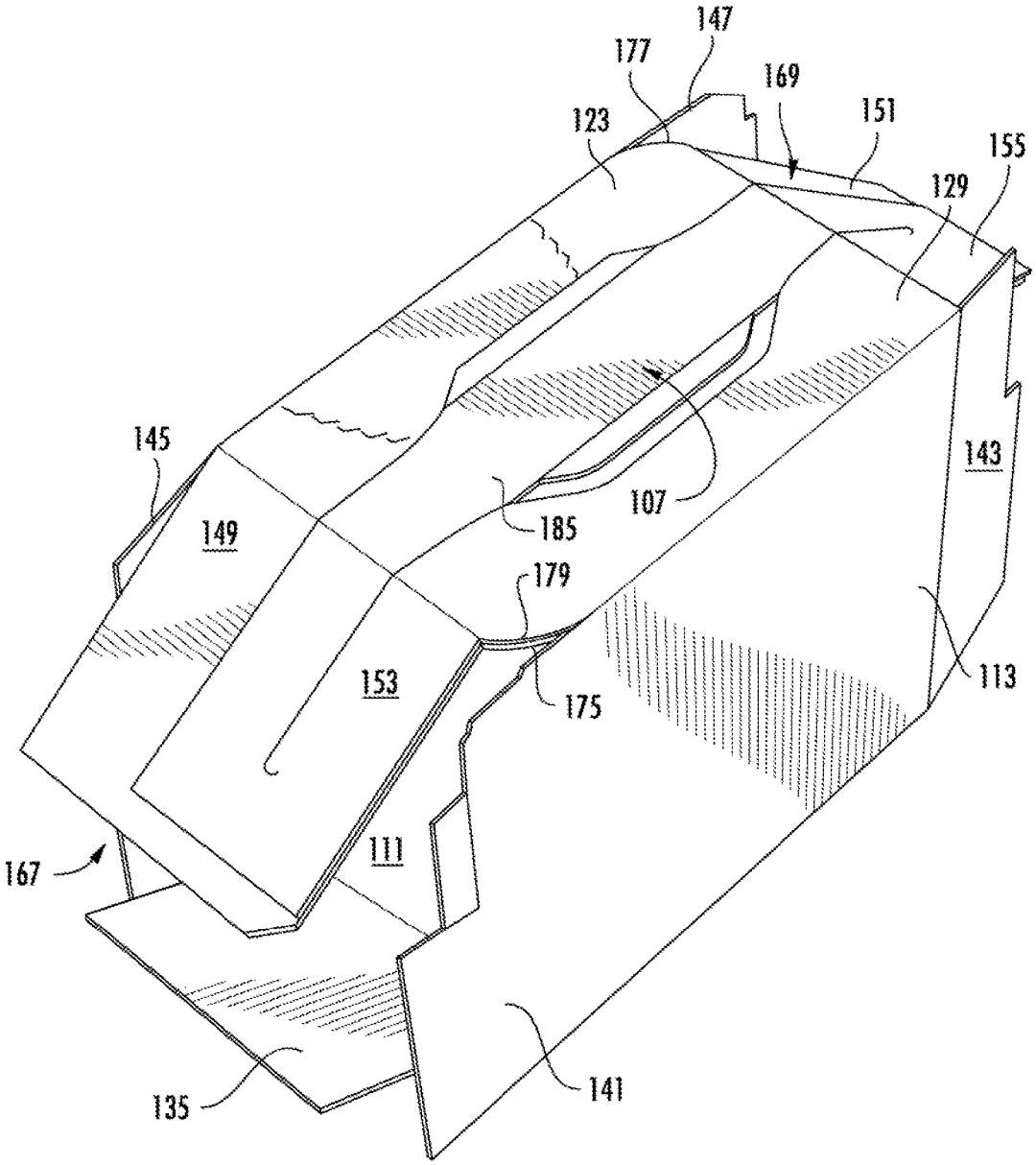
FIG. 1B is a perspective view of a partial assembly of the blank of FIG. 1A.
Figure 1C:
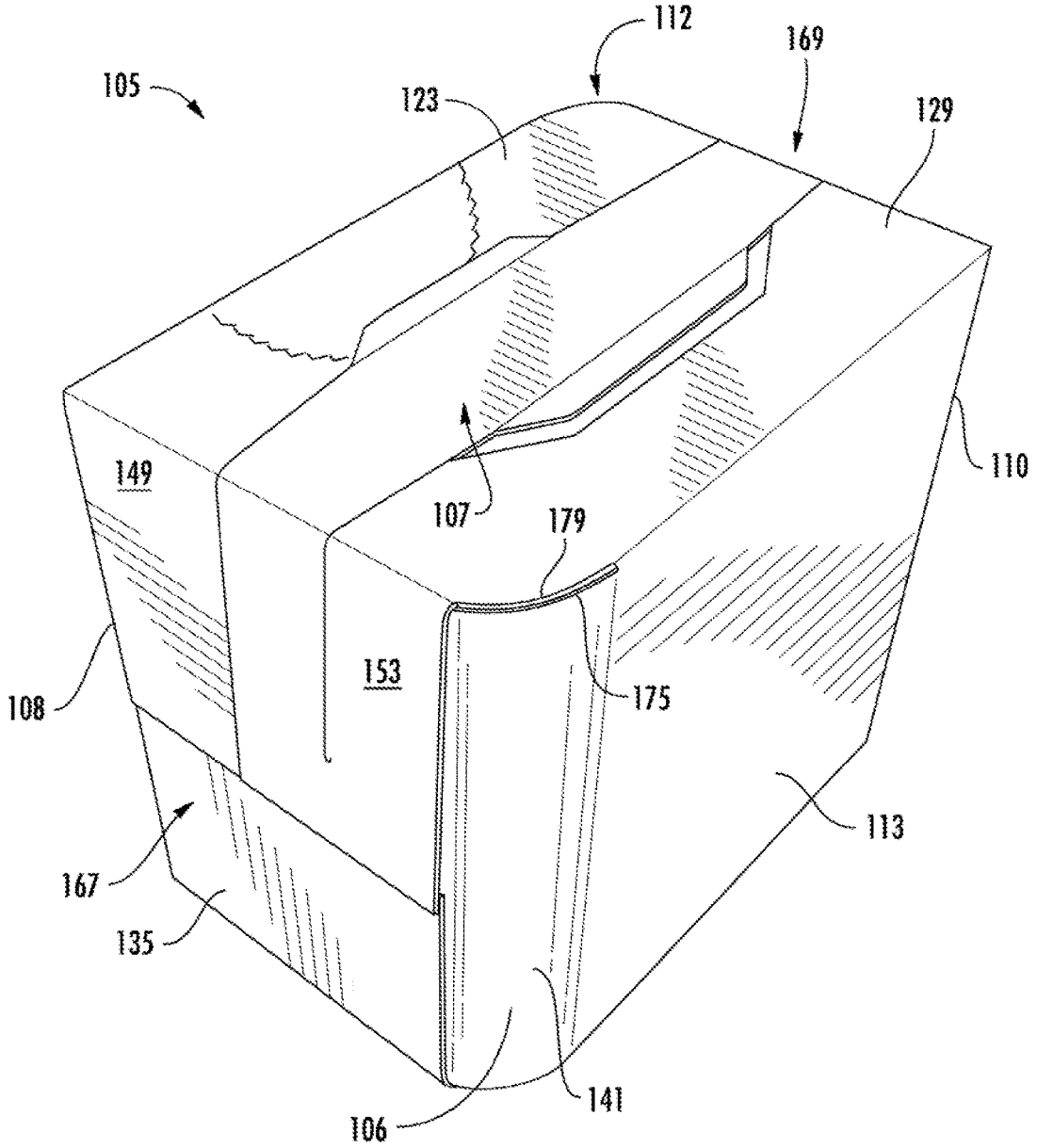
FIG. 1C is a perspective view of a carton formed from the blank of FIG. 1A.

Referring to FIGS. 1A and 1C, the blank 103 has a longitudinal axis L1 and a lateral axis L2. The blank 103 comprises a bottom panel 111 foldably connected to first and second side panels 113, 115 at respective lateral fold lines 117, 119, a first top panel 123 foldably connected to the second side panel 115 at a lateral fold line 125, and a second top panel 129 foldably connected to the first side panel 113 at a lateral fold line 131. The first and second top panels 123, 129 at least partially overlap in the erected carton 105.

The bottom panel 111 is foldably connected to a first bottom end flap 135 and a second bottom end flap 137. The first side panel 113 is foldably connected to a first side end flap 141 and a second side end flap 143. The second side panel 115 is foldably connected to a first side end flap 145 and a second side end flap 147. The first top panel 123 is foldably connected to a first top end flap 149 and a second top end flap 151. The second top panel 129 is foldably connected to a first top end flap 153 and a second top end flap 155.

The end flaps 135, 141, 145, 149, 153 extend along a first marginal area of the blank 103, and at least end flaps 135, 145, and 149 are foldably connected at a first longitudinal fold line 161, with end flap 153 foldably connected to the second top panel 129 by a portion 161*a* of longitudinal fold line 161 extending across the top panel 169. The end flaps 137, 143, 147, 151, 155 extend along a second marginal area of the blank 103, and at least end flaps 137, 143, 151, and 155 are foldably connected at a second longitudinal fold line 163, with end flap 151 foldably connected to the second top panel 129 along another portion 163*a* of fold line 163. The longitudinal fold lines 161, 163 may be, for example, substantially straight, offset, oblique, and/or may include a discontinuity at one or more locations to account for blank thickness or for other factors. For example, the fold line 161 does not extend across the side panel 113 so that the side end flap 141 is foldably connected to the side panel 113 without any fold line or other line of weakening, with the top end flap 153 foldably connected to the top panel 129 by a portion 161*a* of the fold line 161 extending across the top panel 129. Similarly, the fold line 163 does not extend across the side panel 115 so that the side end flap 147 is foldably connected to the side panel 115 without any fold line or line of weakening, with the top end flap 151 foldably connected to the top panel 123 by a portion 163*a* of the fold line 163 extending across the top panel 123. As described herein, the term fold line may refer to a crease formed by mechanical deformation, or another region of weakening, for example, a perforation, trench, channel, discontinuity, or joint formed along a layer or material, to name a few.

When the carton 105 is erected, the end flaps 135, 141, 145, 153, 149 are overlapped to at least partially close the first end 167 of the carton, and the end flaps 137, 143, 147, 151, 155 are overlapped to at least partially close the second end 169 of the carton. In accordance with an alternative embodiment of the present invention, different flap arrangements and closure configurations can be used for closing the ends 167, 169 of the carton 105.

With continued reference to FIGS. 1A and 1C, the bottom panel 111 has a first curved, e.g., rounded, edge 171 extending between the fold lines 117, 161 and a second curved edge 173 extending between the fold lines 119, 163. The first top panel 123 includes a first curved edge 175 extending from the fold line 161 and a second curved edge 177 extending between the fold lines 125, 163*a*. The second top panel 129 includes a curved edge 179 extending between the fold lines 131, 161*a*.

In the exemplary embodiment illustrated, the first top panel 123 includes two handle panels 183*a*, 183*b* extending from the top panel 123 into a respective top end flap 149, 151 and the second top panel 129 includes a handle panel 185 extending across the second top panel and into the top end flaps 153, 155. As shown, the blank 103 may include a dispenser panel 187 defined by a tear line 189 and extending in a portion of the first top panel 123 and a portion of the second side panel 115. The blank 103 and/or carton 105 could have other features and the features shown could be otherwise shaped, arranged, and/or configured without departing from the disclosure.

When the carton 105 is formed form the blank 103, the second top panel 129 overlaps the first top panel 123 so that the curved edges 175, 179 are overlapped and generally aligned to from a top curved edge at the corner 112 of the carton 105 and the curved edge 171 forms a bottom curved edge at the corner 112 of the carton 105.

An exemplary method of erecting the carton 105 from the blank 103 is discussed in detail below. At various stages of the erecting process, glue or other adhesive can be applied to various portions of the blank 103 to facilitate joining portions thereof.

Still referring to FIG. 1A, and with additional reference to FIG. 1B, the blank 103 is folded about fold lines 117, 119, 125, 131 so that the second top panel 129 overlaps the first top panel 123 to form a generally open-ended sleeve. Adhesive can be used to secure the first top panel 123 to the second top panel 129 so that the handle panel 185 overlaps and is secured to the handle panels 183*a*, 183*b* to form the handle 107 in the carton 105 (FIG. 1C). Articles such as beverage containers C can be inserted into the open-ended sleeve prior at closing the ends 167, 169. Alternatively, one of the ends 167, 169 can be closed prior to inserting the beverage containers C into the carton 105.

Figure 1D:
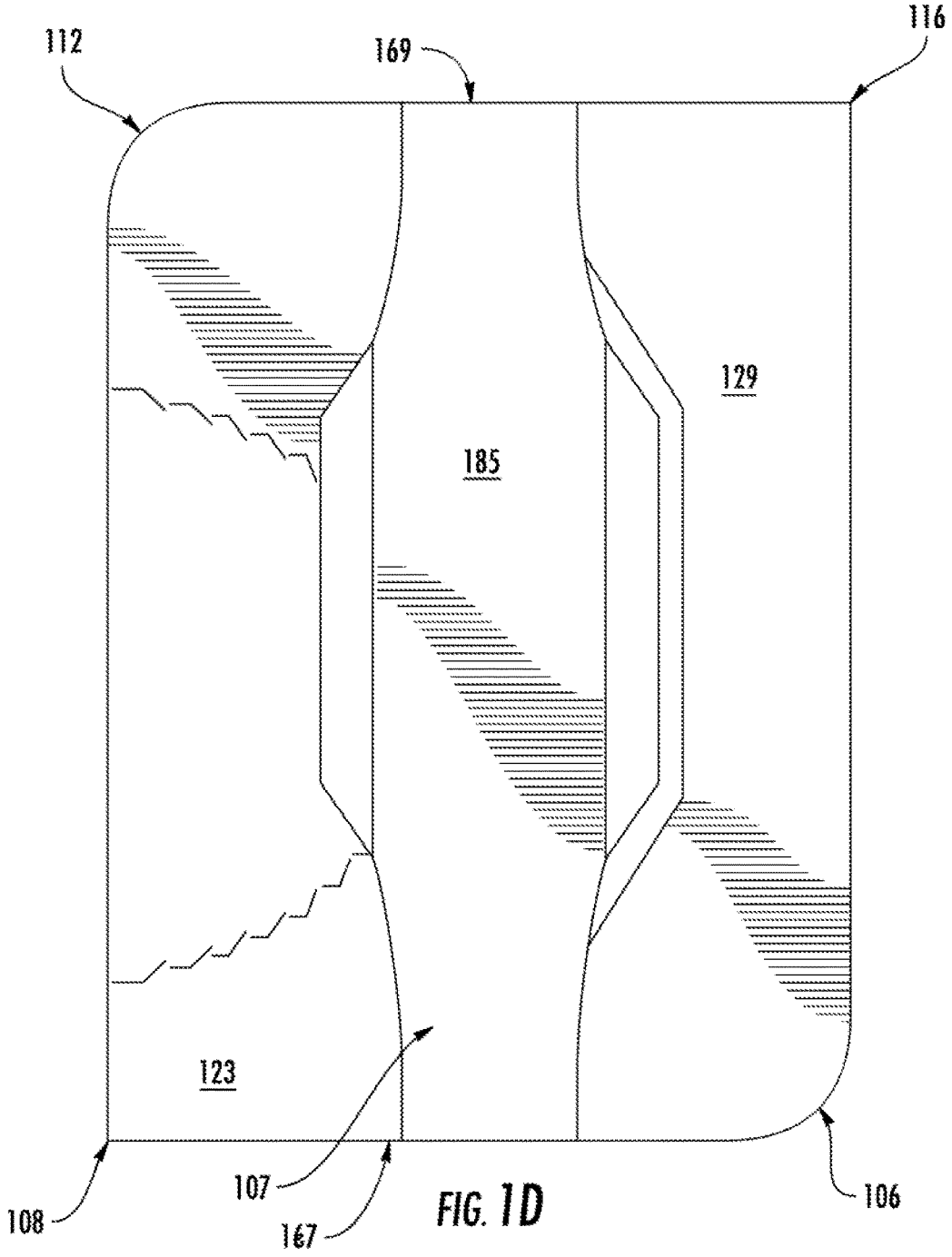
FIG. 1D is a top view of the carton of FIG. 1C.

With continued reference to FIG. 1A, and referring additionally to FIGS. 1C and 1D, when the carton 105 is formed from the blank 103, the second top panel 129 overlaps the first top panel 123 so that the curved edges 175, 179 are overlapped and generally aligned to from a top curved edge at the corner 106 of the carton and the curved edge 171 forms a bottom curved edge at the corner 106. When the end 167 is closed, the end flap 141 is folded to conform to the upper and lower curved edges and form the rounded or curved corner 106 of the carton 105 between the upper and lower curved edges and adjacent the first side panel 113. The corner 110 is a square-shaped corner, e.g., having a substantially perpendicular or orthogonal configuration, adjacent the first side panel 113 and is formed by the intersection of the fold lines 131, 163, 117 and the folding of the end flaps 155, 143, 147. Similarly, the rounded or curved corner 112 is formed upon the closing of the end 169 by the conformance of the end flap 147 with the curved edges 173, 177 and the square or orthogonal corner 108 is formed by the intersection of the fold lines 119, 161, 125 and the folding of the end flaps 135, 145, 149. In this way, the carton 105 has asymmetrical corners in that each end 167, 169 has one rounded or curved corner 106, 112 positioned between and that transitions between the respective closed end flaps and the side panels 113, 115 and one square or orthogonal corner 108, 110 that transitions between the closed end flaps and the side panels 113, 115.

Figure 1E:
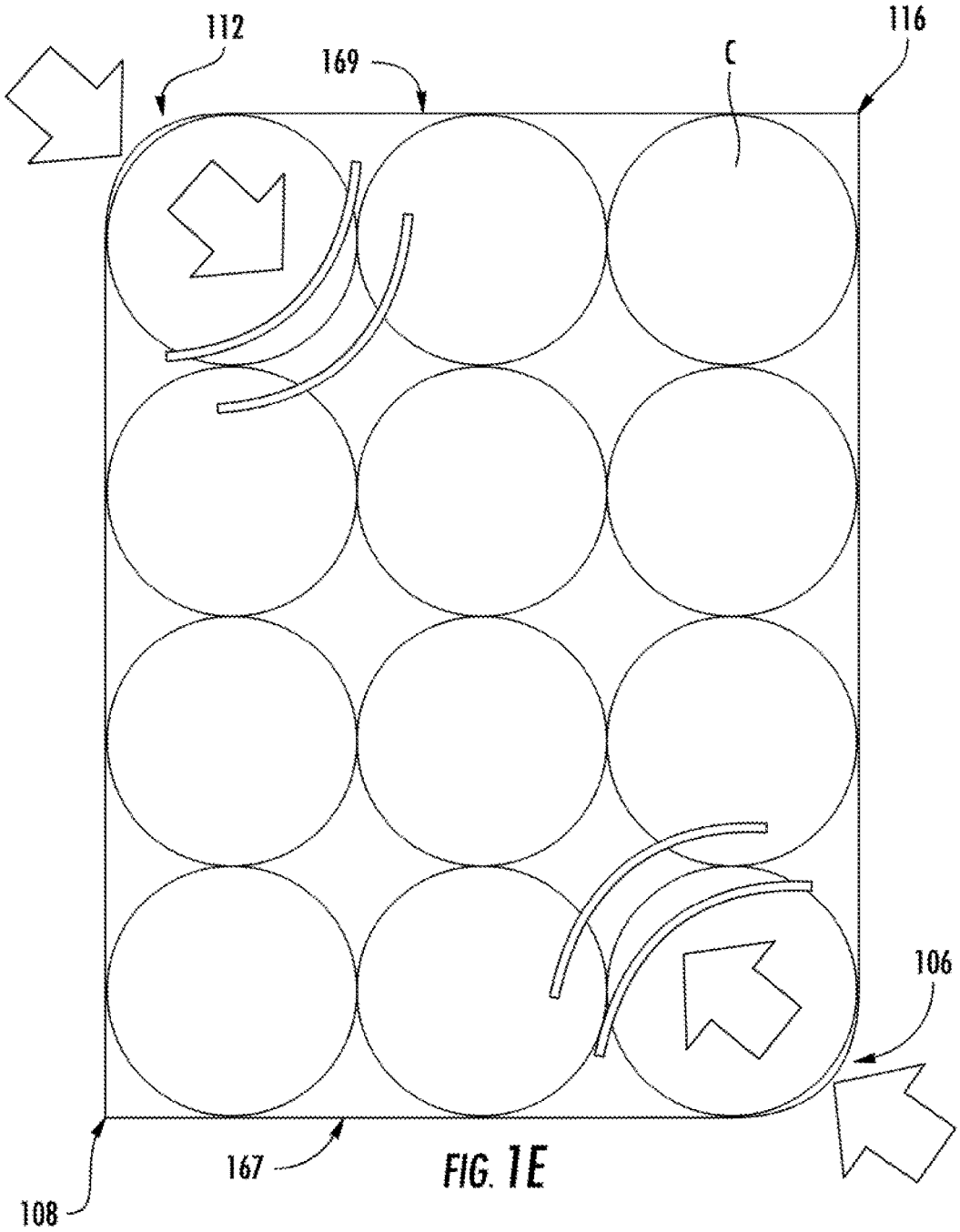
FIG. 1E is a schematic view of an interior of the carton of FIG. 1C showing the position of a plurality of containers disposed therein.

The asymmetrical corners 106, 108 and 110, 112 at each end allow the carton 105 to have more tightly packed containers to tighten the pack by pushing inward at the rounded corners 106, 112 (FIG. 1E). In this regard, the presence of rounded or curved corners 106, 112 reduces what would otherwise be empty interior space at a square or orthogonal corner of a carton. At the same time, the presence of square or orthogonal corners 108, 110 at diagonally opposite positions along the carton 105 allows a degree of movement of articles C such that articles C can be more tightly packed into carton 105 than into a carton having uniform square or orthogonal corners, but while still providing clearance among the articles C, for example, to permit a degree of shifting and/or redistribution during shipping or other movement.

Additionally, indicia or other visual configurations of the exterior of carton 105 may be arranged differently on or near rounded or curved corners 106, 112 and square or orthogonal corners 108, 110 so that indicia or other visual configurations of the carton 105 appear differently based on the consumer's point of view. For example, the presence of asymmetrical corners 106, 108 and 110, 112 in the described configuration yields a carton 105 with corners that, when viewed in sequence around the perimeter of carton 105, have alternating configurations, e.g., starting with corner 106 and proceeding along first side panel 113, a consumer would view a rounded or curved corner (106), a square or orthogonal corner (110), a rounded or curved corner (112), and a square or orthogonal corner (108). Such an alternating configuration may provide a break or disruption in visual perception on the part of the consumer that presents an enhanced opportunity to display indicia disposed on an exterior surface of the carton 105. As another example, when multiple cartons 105 are arranged and/or stacked near each other, the alternating configuration of corners 112, 108, 106, 110 as described above may sufficiently minimize visual uniformity of the cartons 105 to entice and/or allow additional viewing of the surface area of one or more cartons 105 by the user.

Other combinations of asymmetrical corners can be used without departing from the disclosure.

Figure 2A:
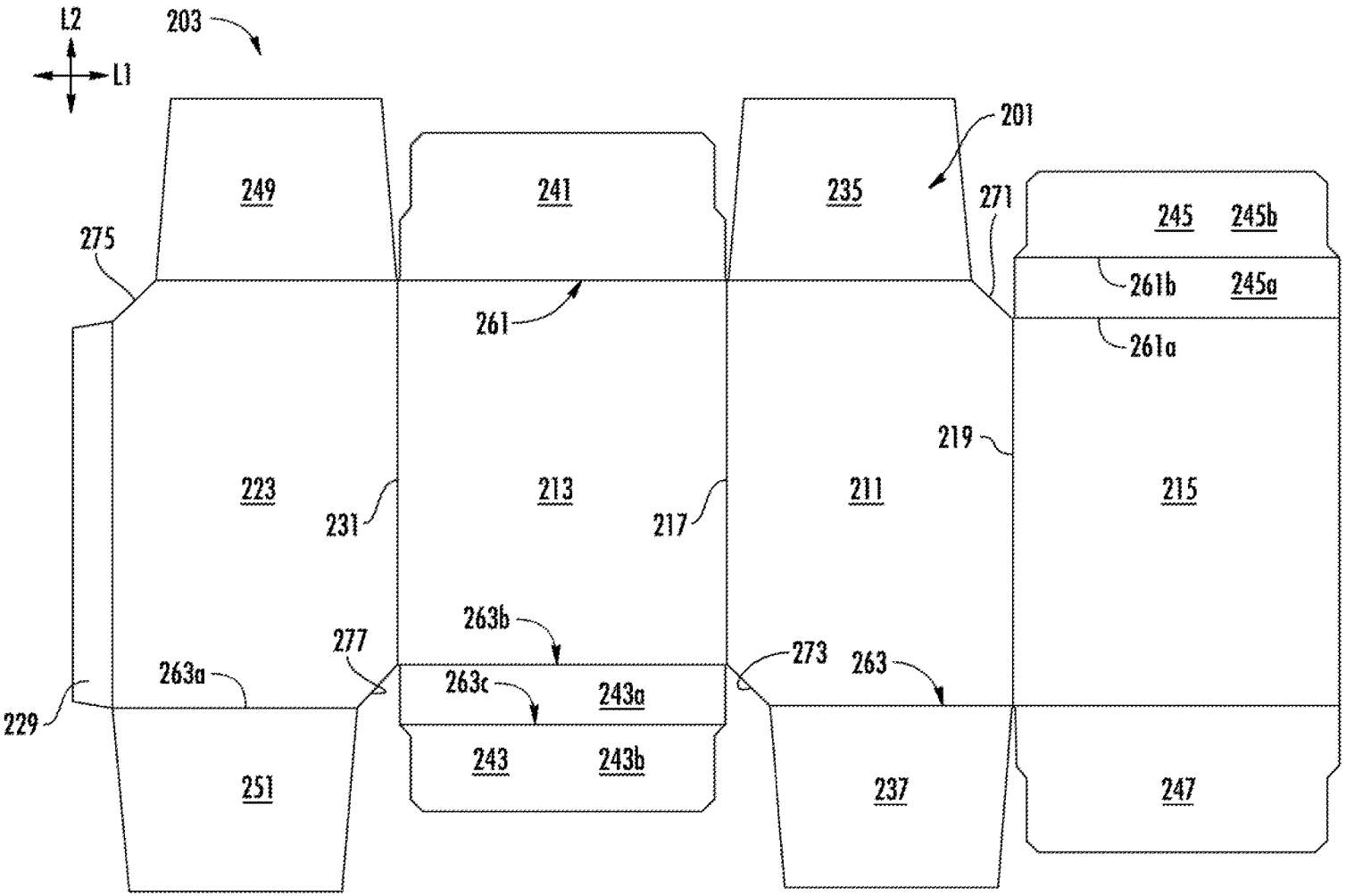
FIG. 2A is a plan view of a blank according to a second embodiment of the present disclosure.

FIG. 2A shows an interior surface 201 of a blank 203 for forming a carton 205 (FIG. 2C) according to a second embodiment of the disclosure. Like or similar reference numbers are used to indicate like or similar features between the first and second embodiments.

In this regard, blank 203 comprises a bottom panel 211 foldably connected to first and second side panels 213, 215 at respective lateral fold lines 217, 219, and a top panel 223 foldably connected to the first side panel 213 at a lateral fold line 231. As shown, an attachment flap 229 may be provided to facilitate attachment of the top panel 223 to the second side panel 215.

As shown, the bottom panel 211 has a first oblique, e.g., chamfered or diagonal, edge 271 extending between the fold lines 219, 261 and a second oblique edge 273 extending between the fold lines 217, 263. The top panel 223 includes a first oblique edge 275 extending from the fold line 261 and a second oblique edge 277 extending between the fold lines 225, 263*a*.

The bottom panel 211 is foldably connected to a first bottom end flap 235 and a second bottom end flap 237. The first side panel 213 is foldably connected to a first side end flap 241 and a second side end flap 243. The second side end flap 243 has a proximal portion 243*a* foldably connected to the first side panel 213 at a fold line 263*b* and a distal portion 243*b* foldably connected to the proximal portion 243*a* at a fold line 263*c*. The second side panel 215 is foldably connected to a first side end flap 245 and a second side end flap 247. The first side end flap 245 has a proximal portion 245*a* foldably connected to the second side panel 215 at a fold line 261*a* and a distal portion 245*b* foldably connected to the proximal portion 245*a* at a fold line 261*b*. The top panel 223 is foldably connected to a first top end flap 249 and a second top end flap 251.

In one embodiment, the end flaps 249, 241, 235, 245 extend along a first marginal area of the blank 203, and at least end flaps 249, 241, and 235 are foldably connected at a first longitudinal fold line 261, with end flap 245 foldably connected to the second side flap 215 by fold line 261*a*. The end flaps 251, 243, 237, 247 extend along a second marginal area of the blank 203, and at least end flaps 237 and 247 are foldably connected at a first longitudinal fold line 261, with end flap 243 foldably connected to the second side flap 215 by fold line 263*b* and end flap 251 foldably connected to the top end flap 223 by a fold line 263*a*. The longitudinal fold lines 261, 263 may be, for example, substantially straight, offset, oblique, and/or may include a discontinuity at one or more locations to account for blank thickness or for other factors.

Figure 2B:
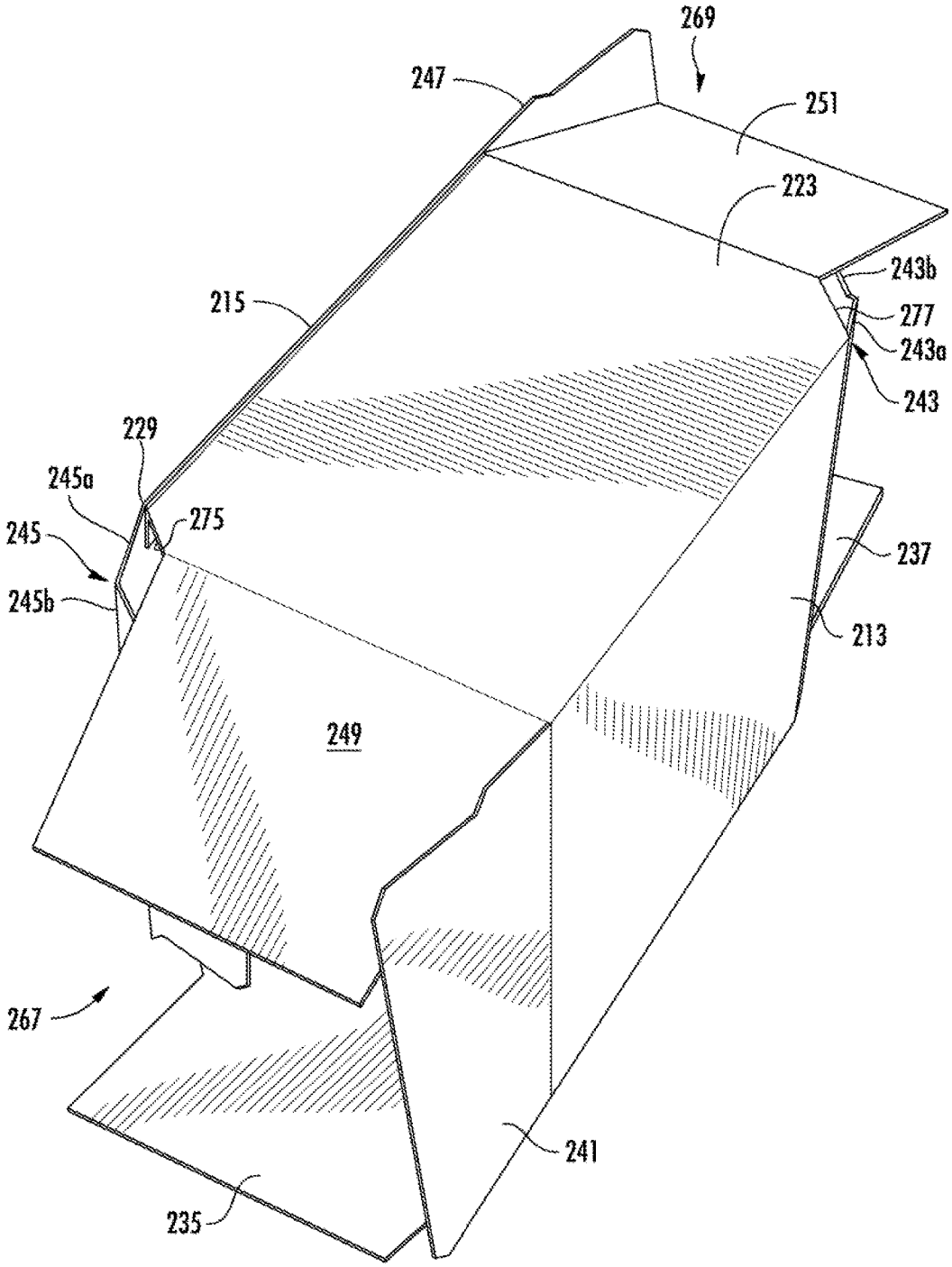
FIG. 2B is a perspective view of a partial assembly of the blank of FIG. 2A.

Still referring to FIG. 2A, and with additional reference to FIG. 2B, the blank 203 can be folded along fold lines 231, 217, and 219 to form a generally open-ended sleeve. Articles such as beverage containers C (FIG. 2E) can be inserted into the open-ended sleeve prior to closing the ends 267, 269. Alternatively, one of the ends 267, 269 can be closed prior to inserting the beverage containers C into the carton 205.

Figure 2C:
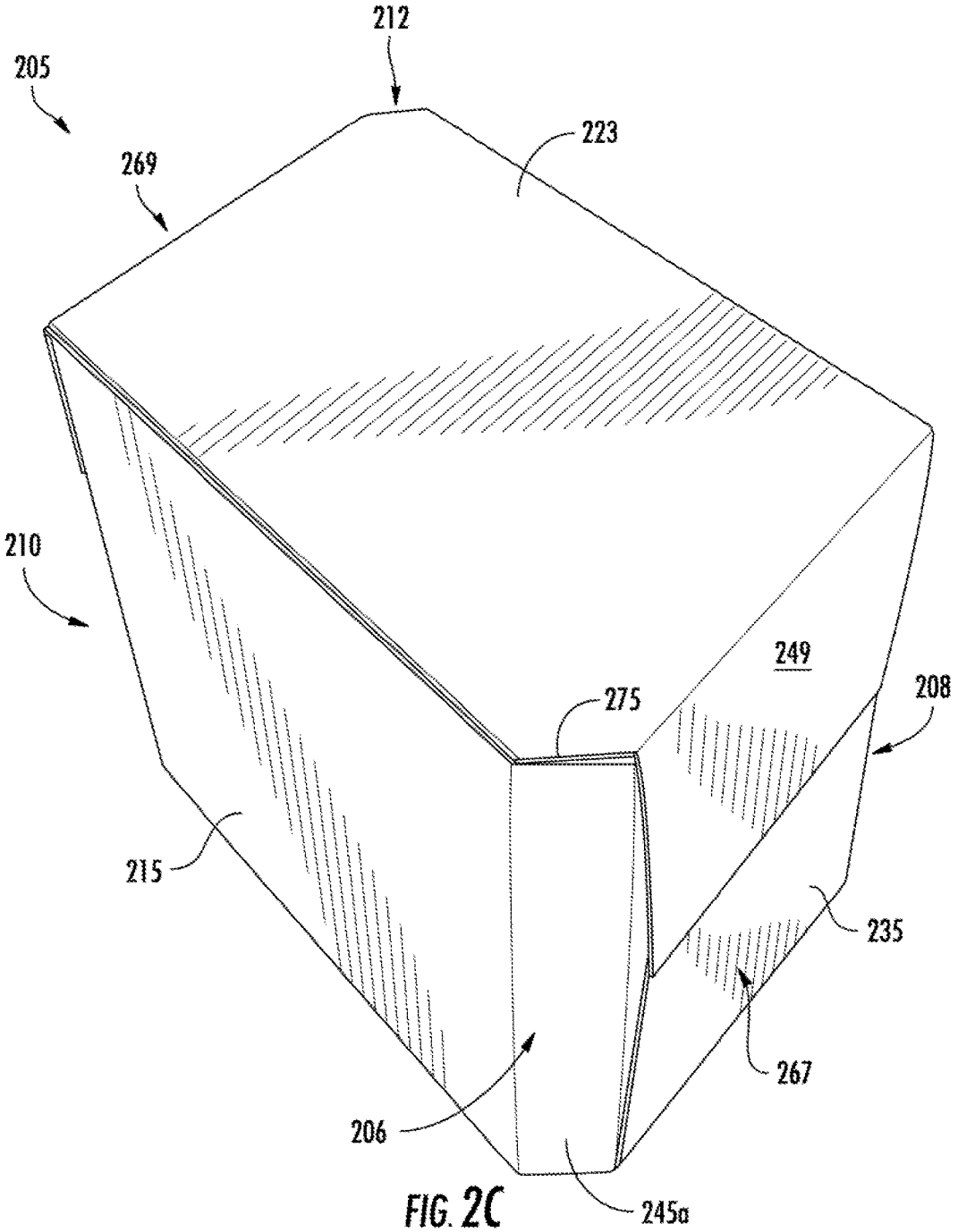
FIG. 2C is a perspective view of a carton formed from the blank of FIG. 2A.
Figure 2D:
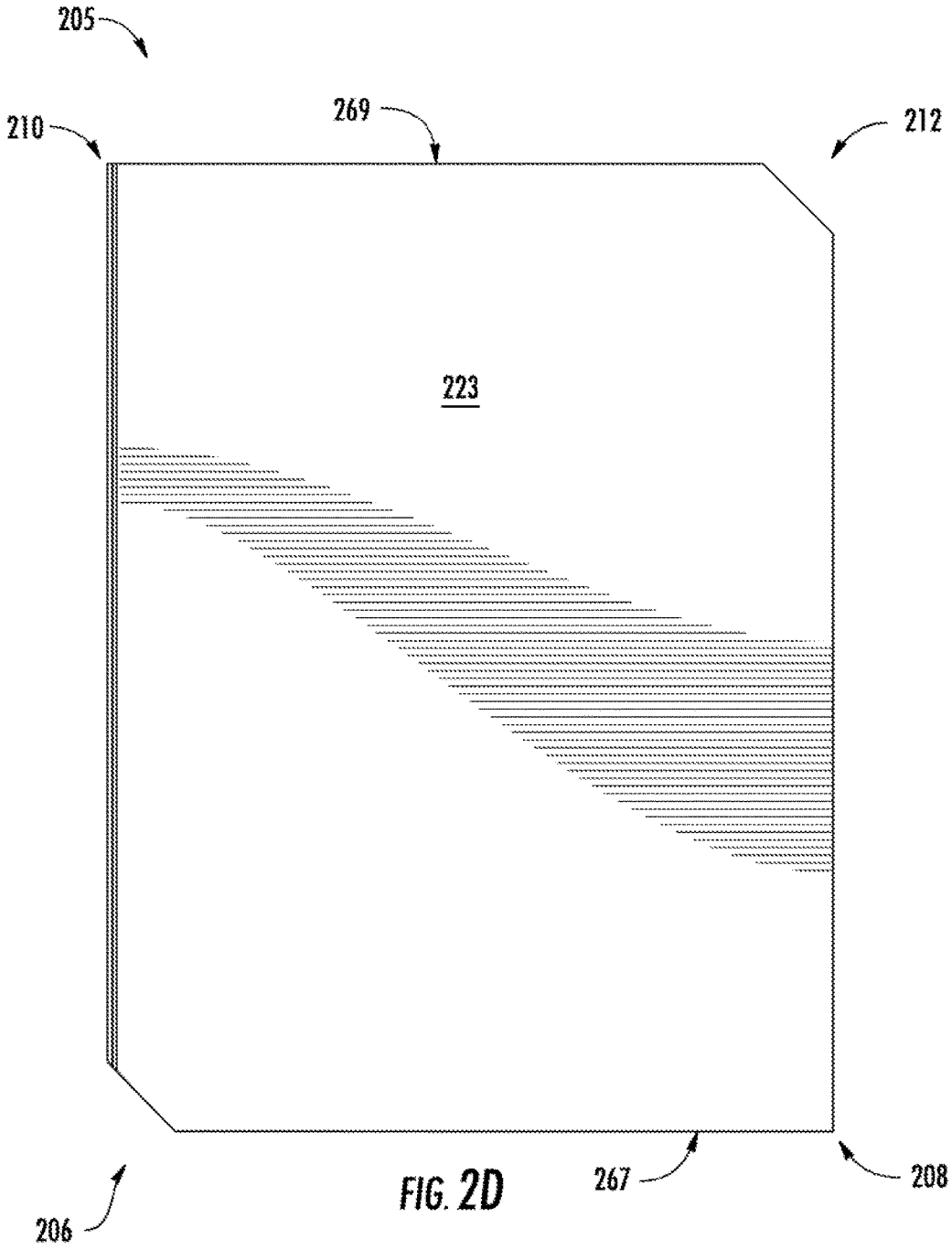
FIG. 2D is a top view of the carton of FIG. 2C.

With continued reference to FIG. 2A, and with additional reference to FIGS. 2C and 2D, each end 267, 269 includes one beveled or oblique corner 206, 212 and one square or orthogonal corner 208, 210. As described above, the top panel 223 has oblique edges 275, 277 and the bottom panel 211 has oblique edges 271, 273. The oblique edges 271, 275 and the proximal portion 245*a* of the end flap 245 combine to form the oblique corner 206 at the closed end 267 of the carton 205 and the oblique edges 273, 277 and the proximal portion 243*a* of the end flap 243 combine to form the oblique corner 212 at the closed end 269 of the carton 205. Similarly, the square corners 208, 210 are respectively formed by the intersections of longitudinal fold line 261 and end flaps 249, 241, and 235, and the intersections of longitudinal fold line 263 and end flaps 251, 237, and 247. The carton 205 could have other features or be otherwise shaped, arranged, and/or configured without departing from the disclosure.

Figure 2E:
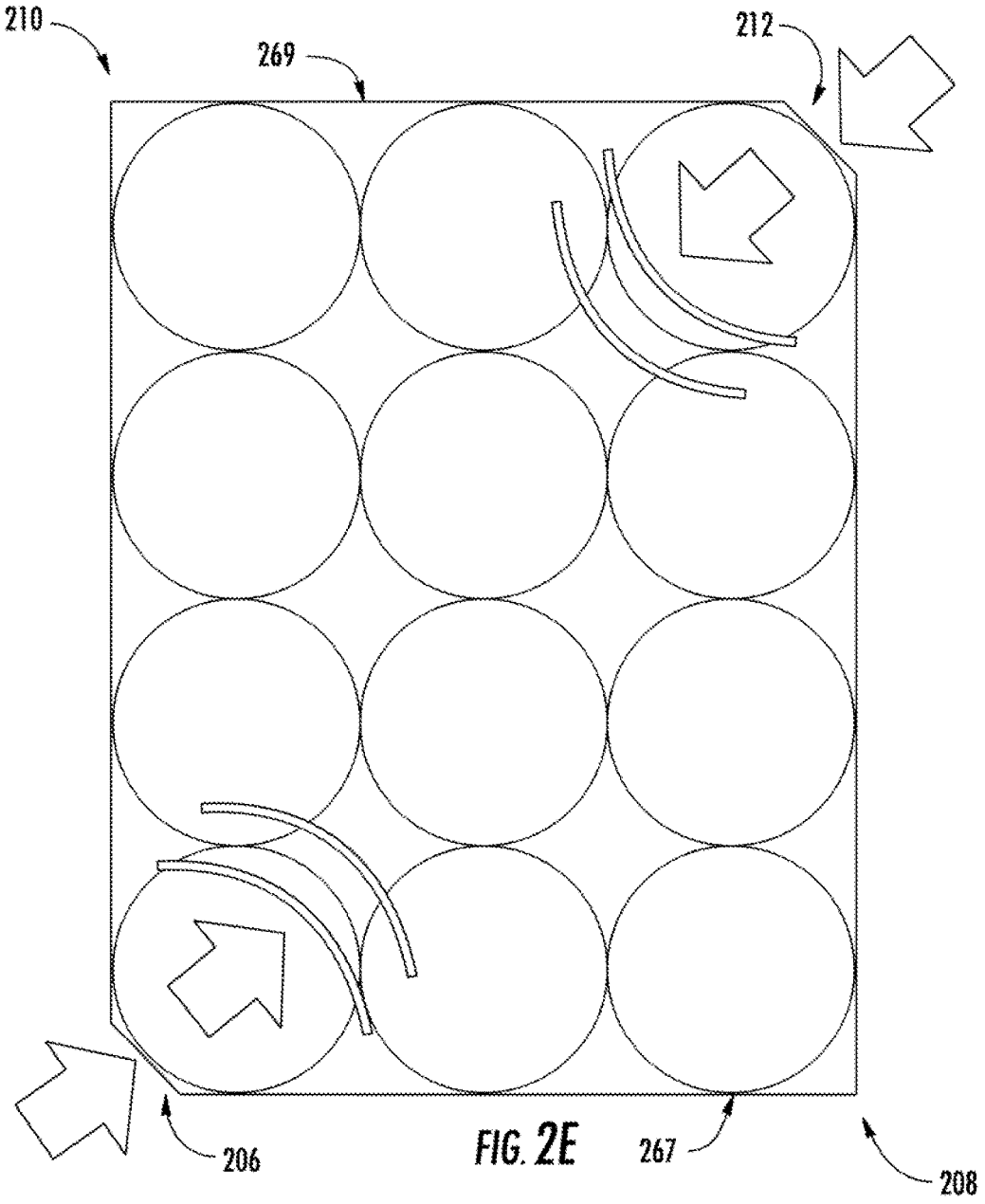
FIG. 2E is a schematic view of an interior of the carton of FIG. 2C showing the position of a plurality of containers disposed therein.

The asymmetrical corners 206, 208 and 210, 212 at each end allow the carton 205 to have more tightly packed containers to tighten the pack by pushing inward at the oblique corners 206, 212 (FIG. 2E). In this regard, the presence of oblique corners 206, 212 reduces what would otherwise be empty interior space at a square or orthogonal corner of a carton. At the same time, the presence of square or orthogonal corners 208, 210 at diagonally opposite positions along the carton 205 allows a degree of movement of articles C such that articles C can be more tightly packed into carton 205 than into a carton having uniform square or orthogonal corners, but while still providing clearance among the articles C, for example, to permit a degree of shifting and/or redistribution during shipping or other movement.

Additionally, indicia or other visual configurations of the exterior of carton 205 may be arranged differently on or near oblique corners 206, 212 and square or orthogonal corners 208, 210 so that indicia or other visual configurations of the carton 205 appear differently based on the consumer's point of view. For example, the presence of asymmetrical corners 206, 208 and 210, 212 in the described configuration yields a carton 205 with corners that, when viewed in sequence around the perimeter of carton 205, have alternating configurations, e.g., starting with corner 208 and proceeding along first side panel 213, a consumer would view a square or orthogonal corner (208), an oblique corner (212), a square or orthogonal corner (210), and an oblique corner (206). Such an alternating configuration may provide a break or disruption in visual perception on the part of the consumer that presents an enhanced opportunity to display indicia disposed on an exterior surface of the carton 205. As another example, when multiple cartons 205 are arranged and/or stacked near each other, the alternating configuration of corners 212, 208, 206, 210 as described above may sufficiently minimize visual uniformity of the cartons 205 to entice and/or allow additional viewing of the surface area of one or more cartons 205 by the user.

Figure 3A:
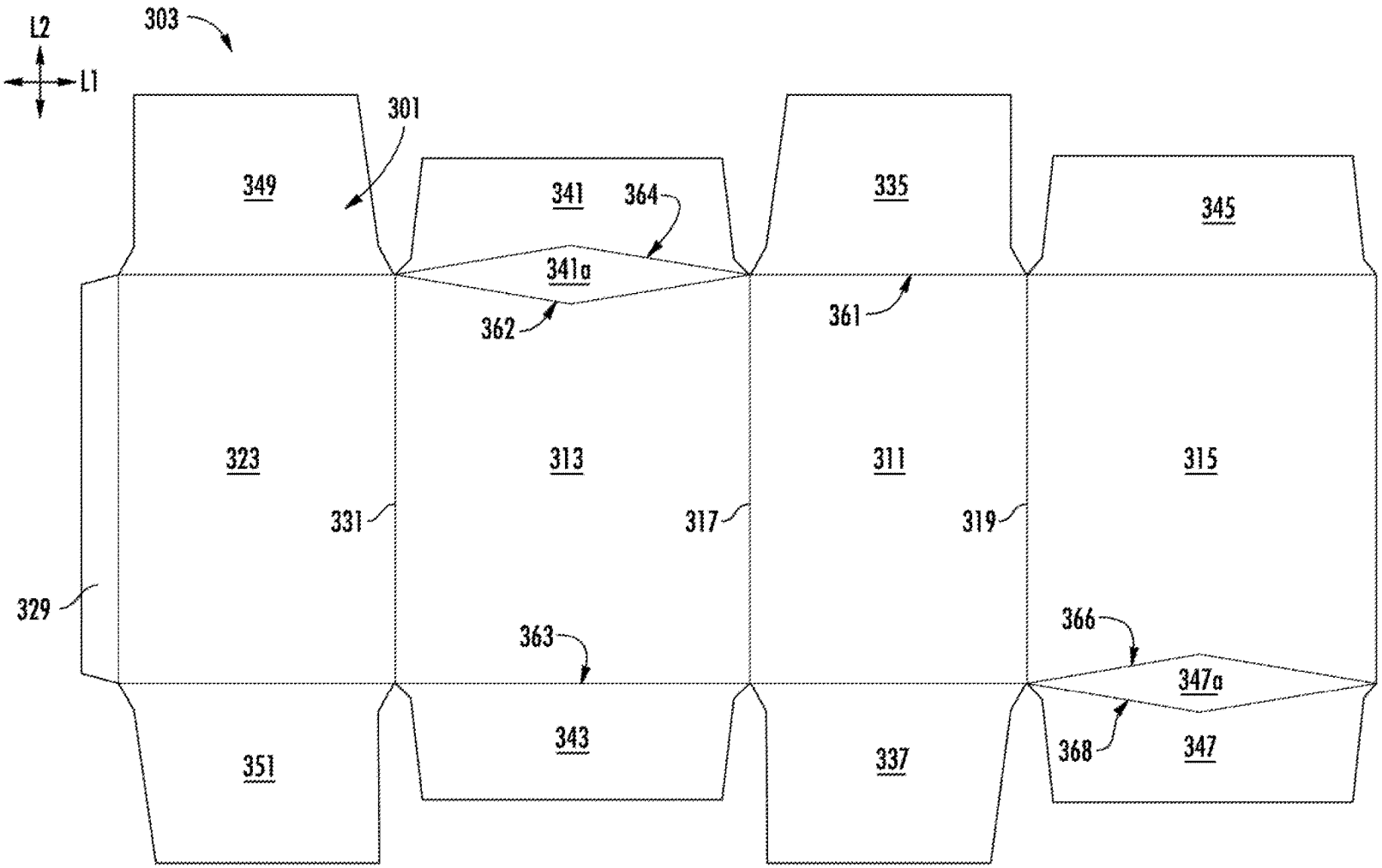
FIG. 3A is a plan view of a blank according to a third embodiment of the present disclosure.

FIG. 3A shows an exterior surface 301 of a blank 303 for forming a carton 305 according to a third embodiment of the disclosure. Like or similar reference numbers are used to indicate like or similar features between the various embodiments.

In this regard, blank 303 comprises a bottom panel 311 foldably connected to first and second side panels 313, 315 at respective lateral fold lines 317, 319, and a top panel 323 foldably connected to the first side panel 313 at a lateral fold line 331. As shown, an attachment flap 329 may be provided to facilitate attachment of the top panel 323 to the second side panel 315.

The bottom panel 311 is foldably connected to a first bottom end flap 335 and a second bottom end flap 337 and the top panel 323 is foldably connected to a first top end flap 349 and a second top end flap 351. The first side panel 313 includes a first end flap 341 and a second end flap 343, and the second side panel 315 includes a first end flap 345 and a second end flap 347. The end flap 341 of the first side panel 313 includes a first diamond-shaped, e.g., having a parallelogram or rhomboid configuration, panel 341*a* formed by two fold lines 362, 364 extending between the top panel 323 and the bottom panel 311. The end flap 347 of the second side panel 315 includes a second diamond-shaped panel 347*a* formed by two fold lines 366, 368 extending from the bottom panel 311.

The end flaps 349, 341, 335, 345 extend along a first marginal area of the blank 303, and at least end flaps 335 and 345 are foldably connected at a first longitudinal fold line 361, with end flap 341 foldably connected to the first side flap 313 by fold line 362 and end flap 349 foldably connected to the top end flap 323 by another portion of fold line 361. The end flaps 351, 343, 337, 347 extend along a second marginal area of the blank 303, and at least end flaps 351, 343, and 347 are foldably connected at a second longitudinal fold line 363, with end flap 347 foldably connected to the second side flap 315 by fold line 366. The longitudinal fold lines 361, 363 may be, for example, substantially straight, offset, oblique, and/or may include a discontinuity at one or more locations to account for blank thickness or for other factors.

Figure 3B:
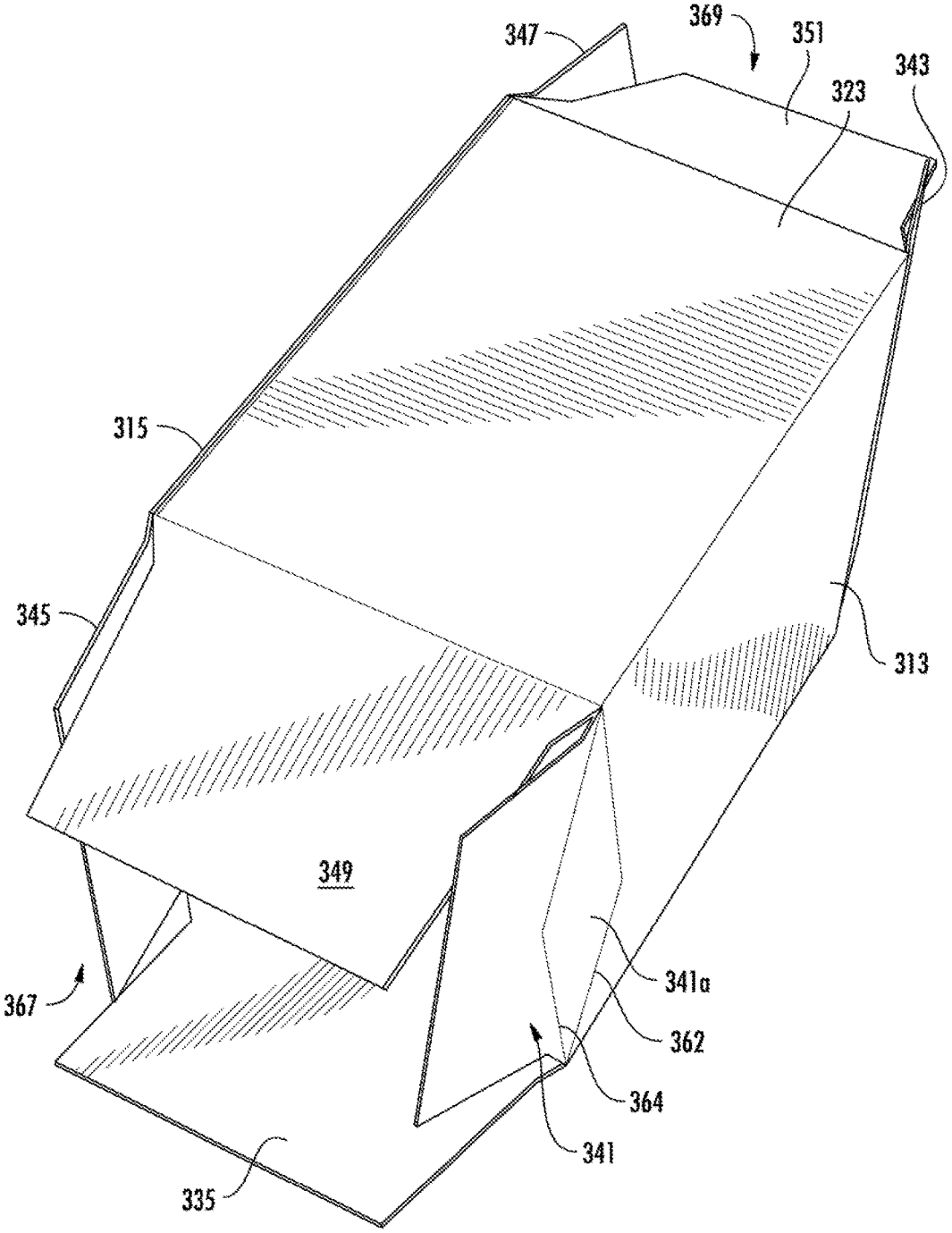
FIG. 3B is a perspective view of a partial assembly of the blank of FIG. 3A.

Still referring to FIG. 3A, and with additional reference to FIG. 3B, the blank 303 can be folded about fold lines 331, 317, 319 to form a generally open-ended sleeve. Articles such as beverage containers C can be inserted into the open-ended sleeve prior to closing the ends 367, 369. Alternatively, one of the ends 367, 369 can be closed prior to inserting the beverage containers C into the carton 303.

Figure 3C:
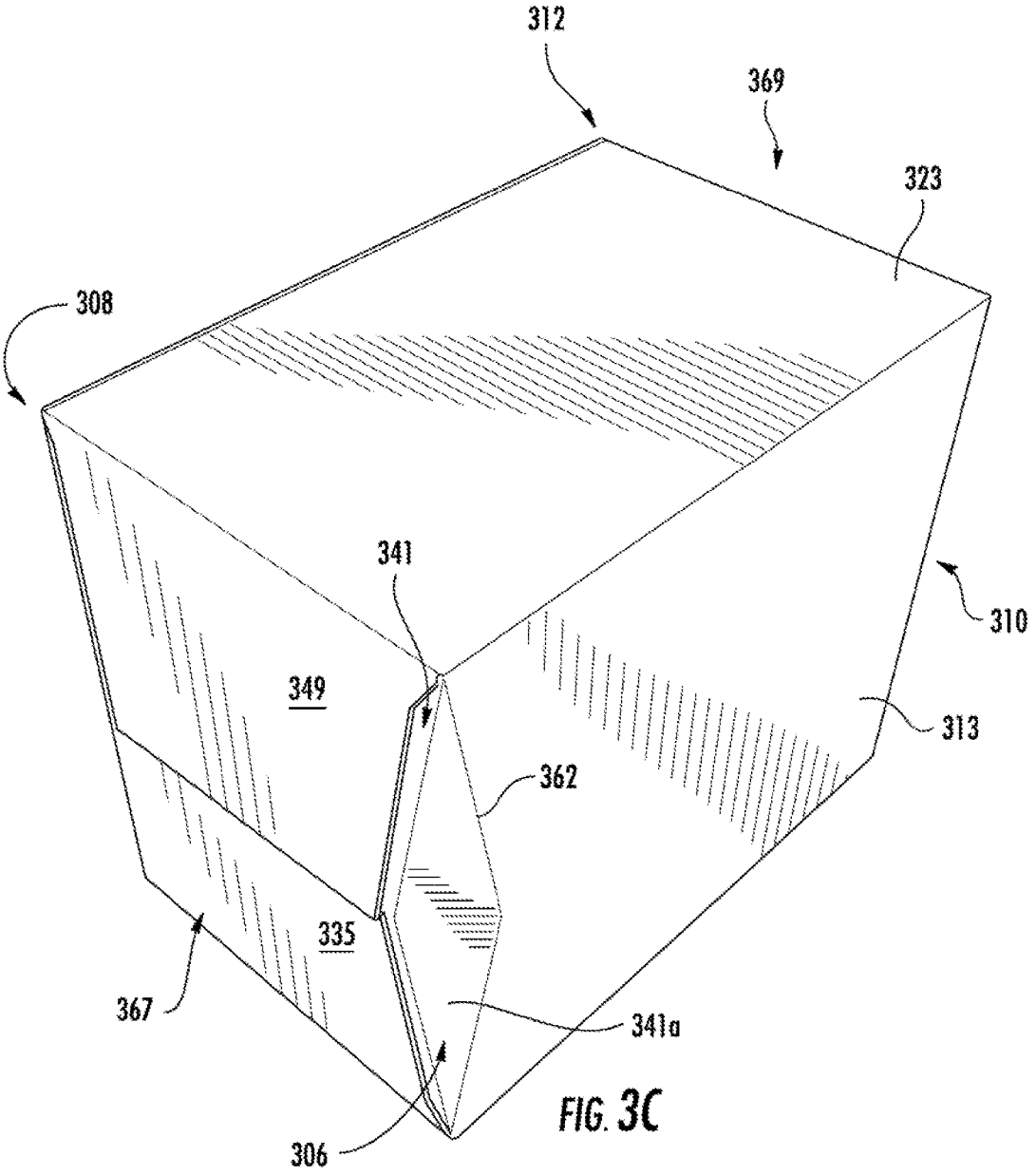
FIG. 3C is a perspective view of a carton formed from the blank of FIG. 3A.
Figure 3D:
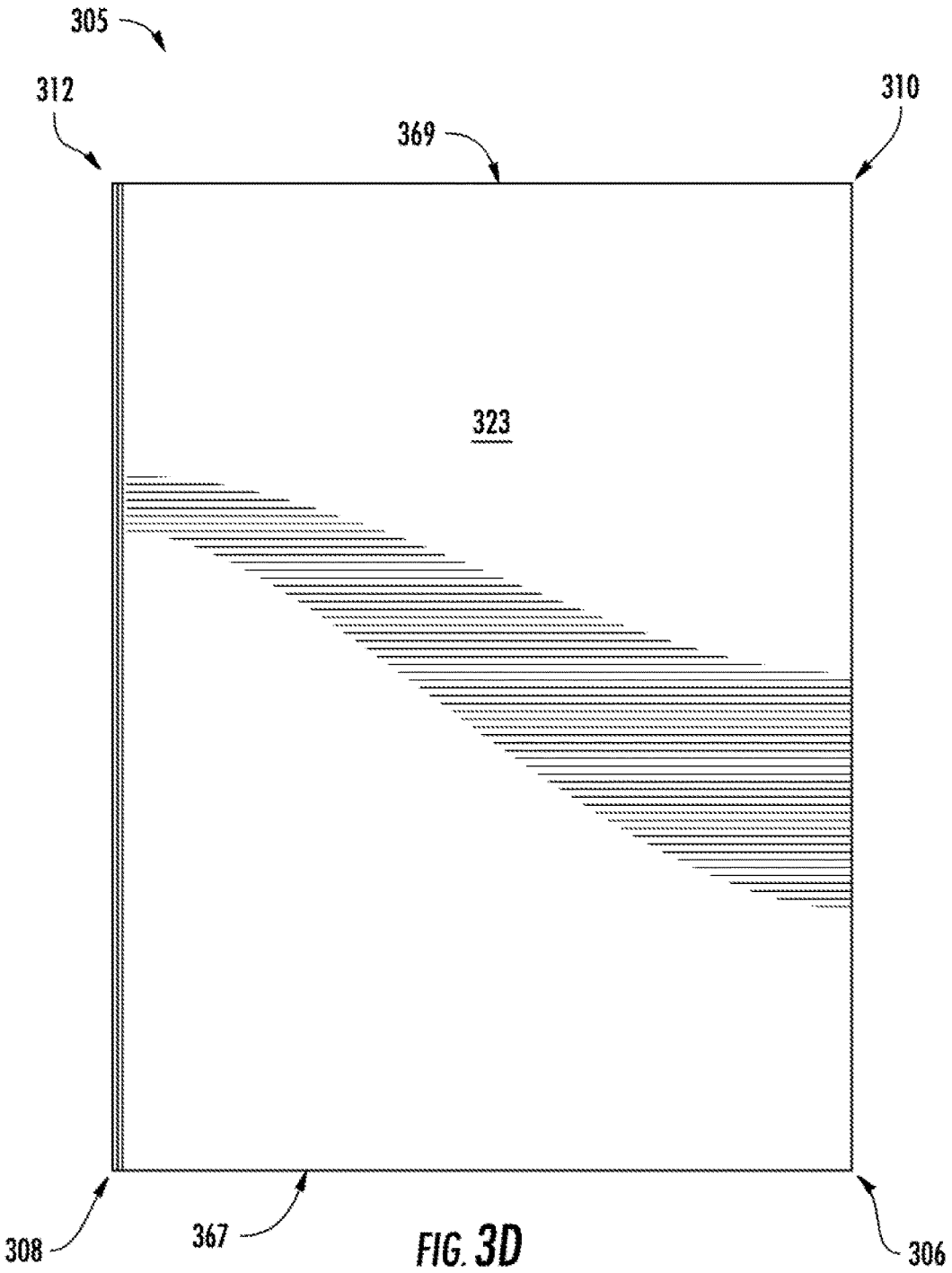
FIG. 3D is a top view of the carton of FIG. 3C.

With continued reference to FIG. 3A, and with additional reference to FIGS. 3C and 3D, each end 367, 369 includes one diamond corner 306, 312 and one square or orthogonal corner 308, 310. In the third embodiment, the blank 303 includes a diamond corner panel 341*a* formed by two fold lines 362, 364 extending between the top panel 323 and the bottom panel 311. The diamond corner panel 341*a* forms the diamond corner 306 at the closed end 367 of the carton 305 and the diamond corner 347*a* forms the diamond corner 312 at the closed end 369 of the carton 305. The square corners 308, 310 are respectively formed by the intersection of fold line 361 and end flaps 349, 335, and 345, and the intersection of fold line 363 and end flaps 351, 343, and 337. The carton 305 could have other features or be otherwise shaped, arranged, and/or configured without departing from the disclosure.

The asymmetrical corners 306, 308 and 310, 312 at each end allow the carton 305 to have more tightly packed containers to tighten the pack by pushing inward at the diamond corners 306, 312. In this regard, the presence of diamond corners 306, 312 reduces what would otherwise be empty interior space at a square or orthogonal corner of a carton. At the same time, the presence of square or orthogonal corners 308, 310 at diagonally opposite positions along the carton 305 allows a degree of movement of articles C such that articles C can be more tightly packed into carton 305 than into a carton having uniform square or orthogonal corners, but while still providing clearance among the articles C, for example, to permit a degree of shifting and/or redistribution during shipping or other movement.

Additionally, indicia or other visual configurations of the exterior of carton 305 may be arranged differently on or near diamond corners 306, 312 and square or orthogonal corners 308, 310 so that indicia or other visual configurations of the carton 305 appear differently based on the consumer's point of view. For example, the presence of asymmetrical corners 306, 308 and 310, 312 in the described configuration yields a carton 305 with corners that, when viewed in sequence around the perimeter of carton 305, have alternating configurations, e.g., starting with corner 306 and proceeding along first side panel 313, a consumer would view a diamond corner (306), a square or orthogonal corner (310), a diamond corner (312), and a square or orthogonal corner (308). Such an alternating configuration may provide a break or disruption in visual perception on the part of the consumer that presents an enhanced opportunity to display indicia disposed on an exterior surface of the carton 305. As another example, when multiple cartons 305 are arranged and/or stacked near each other, the alternating configuration of corners 312, 308, 306, 310 as described above may sufficiently minimize visual uniformity of the cartons 305 to entice and/or allow additional viewing of the surface area of one or more cartons 305 by the user.

Figure 4A:
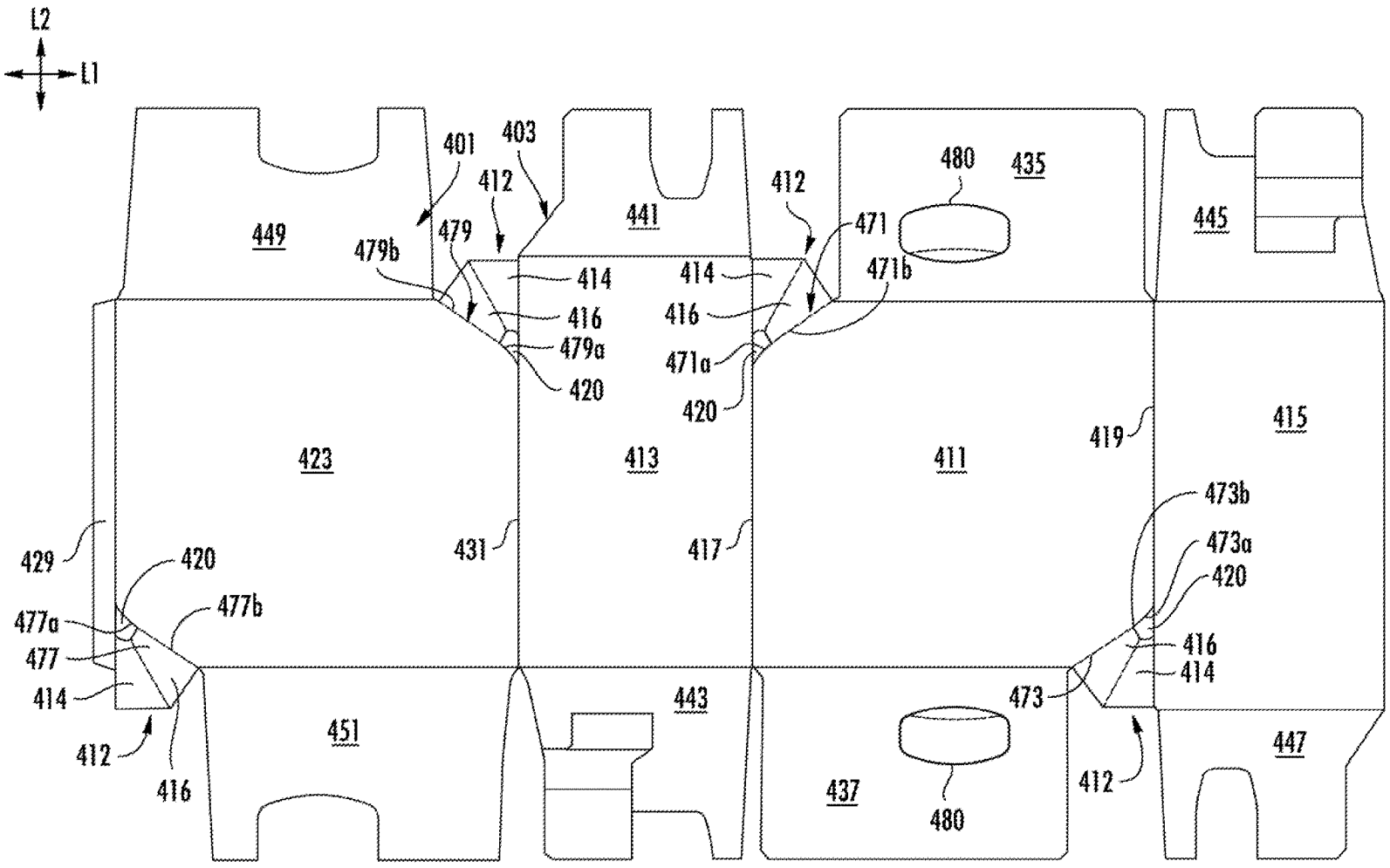
FIG. 4A is a plan view of a blank according to another exemplary embodiment of the present disclosure.

FIG. 4A shows an interior surface 401 of a blank 403 for forming a carton 405 according to a fourth embodiment of the disclosure. Like or similar reference numbers are used to indicate like or similar features between the various embodiments.

In this regard, blank 403 comprises a bottom panel 411 foldably connected to first and second side panels 413, 415 at respective lateral fold lines 417, 419, and a top panel 423 foldably connected to the first side panel 413 at a lateral fold line 431. As shown, an attachment flap 429 may be provided to facilitate attachment of the top panel 423 to the second side panel 415.

As shown, the blank 403 includes gussets 412 that include a first gusset panel 414 and a second gusset panel 416. In this regard, gussets 412 are located between the top panel 423 and the first side panel 413, between the bottom panel 411 and the first side panel 413, between the bottom panel 411 and the second side panel 415, and between the top panel 423 and the second side panel 415. The top panel 423 includes an edge 479 that comprises an oblique fold line 479*b* connecting the gusset panel 416 to the top panel 423 and a curved edge 479*a* extending from the oblique fold line and adjacent an opening 420. The top panel 423 also includes an edge 477 that comprises an oblique fold line 477*b* connecting the gusset panel 416 to the top panel 423 and a curved edge 477*a* extending from the oblique fold line and adjacent an opening 420. Similarly, the bottom panel 411 includes an edge 471 comprising oblique fold line 471*b* and curved edge 471*a*. The bottom panel 411 also includes an edge 473 comprising oblique fold line 473*b* and curved edge 473*a*.

The bottom panel 411 is foldably connected to a first bottom end flap 435 and a second bottom end flap 437, each of which may include a handle flap 480 formed therein. The first side panel 413 is foldably connected to a first side end flap 441 and a second side end flap 443. The second side panel 415 is foldably connected to a first side end flap 445 and a second side end flap 447. The top panel 423 is foldably connected to a first top end flap 449 and a second top end flap 451.

Figure 4B:
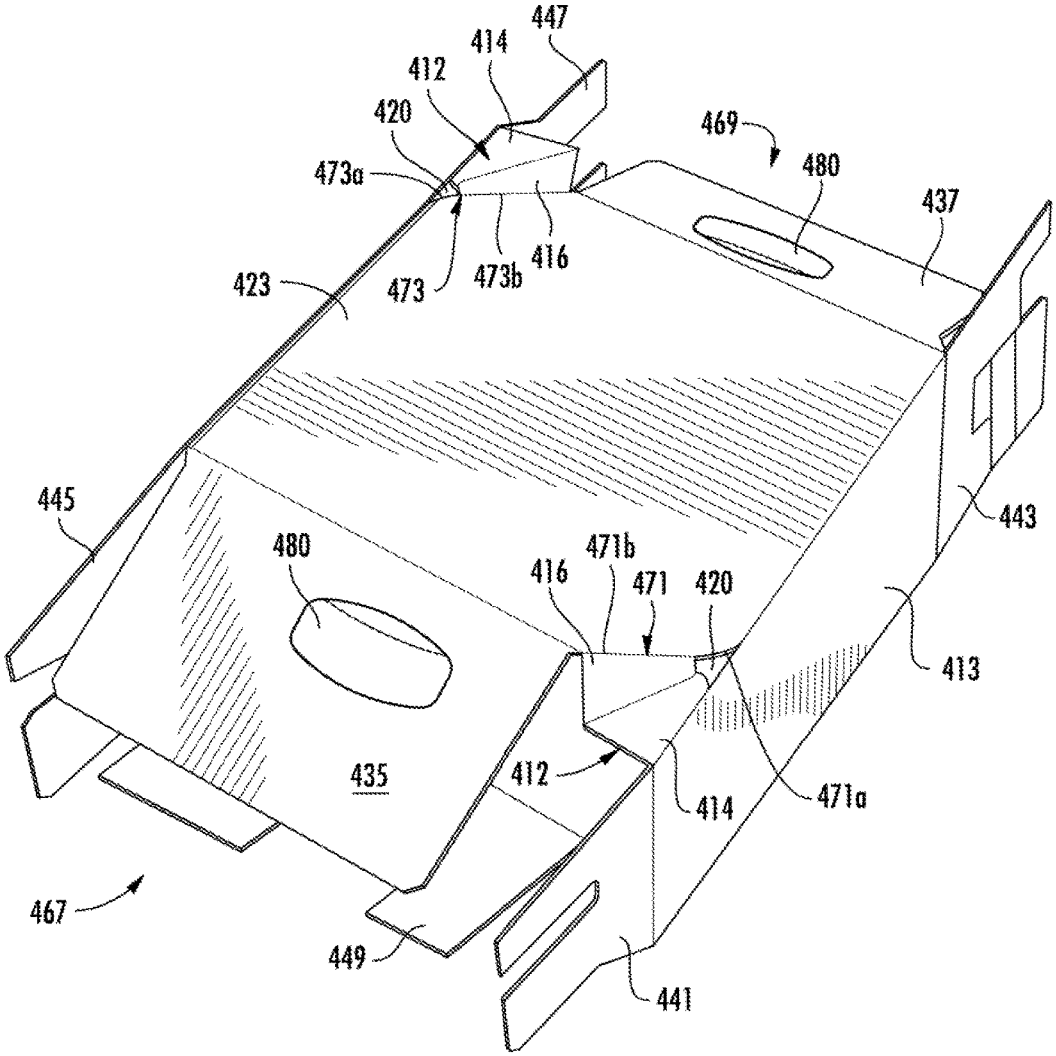
FIG. 4B is a perspective view of a partial assembly of the blank of FIG. 4A.

Still referring to FIG. 4A, and with additional reference to FIG. 4B, the blank 403 can be folded about fold lines 431, 417, 419 to form a generally open-ended sleeve. Articles such as beverage containers C can be inserted into the open-ended sleeve prior to closing the ends 467, 469. Alternatively, one of the ends 467, 469 can be closed prior to inserting the beverage containers into the carton 405.

Figure 4C:
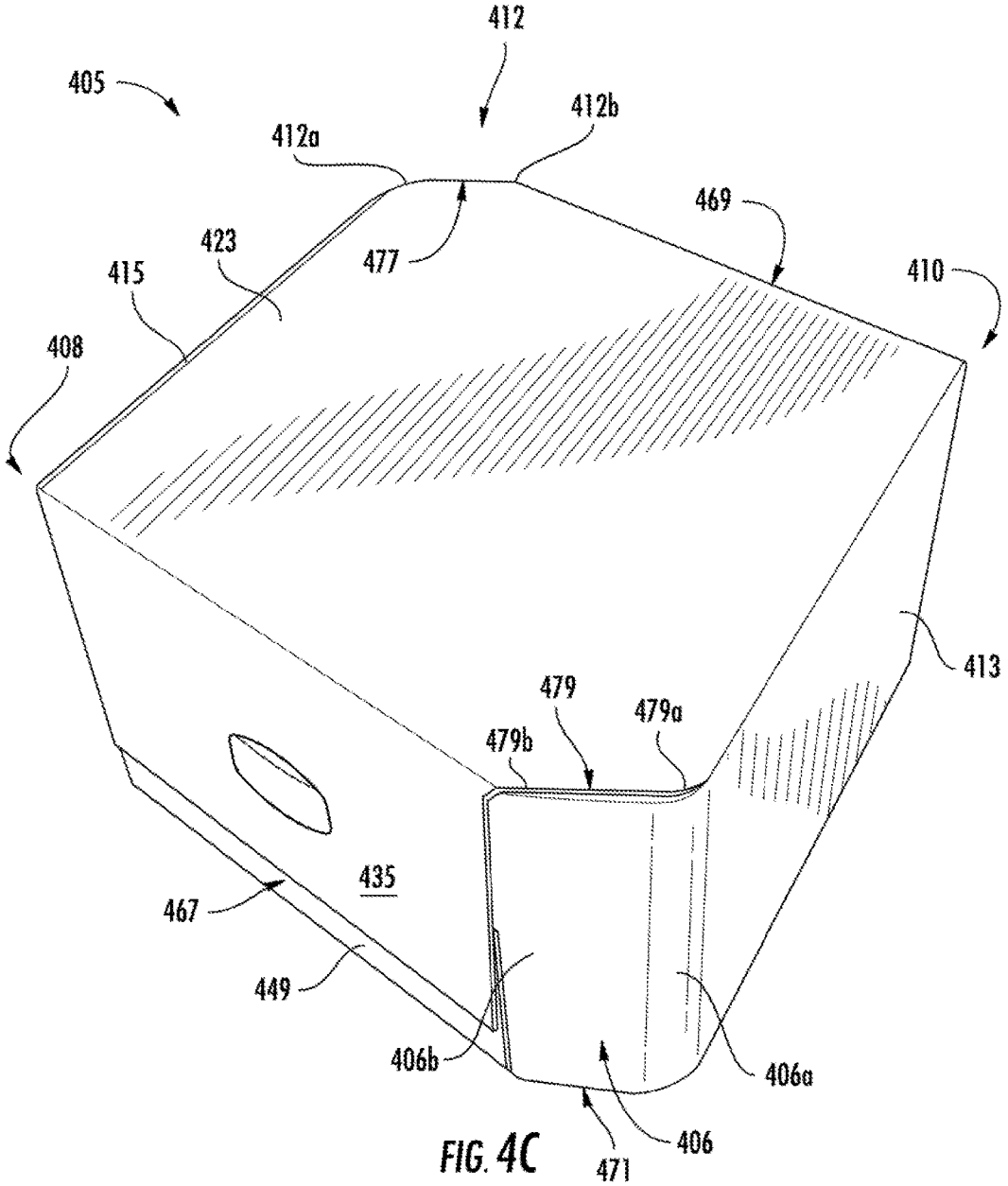
FIG. 4C is a perspective view of a carton formed from the blank of FIG. 4A.
Figure 4D:
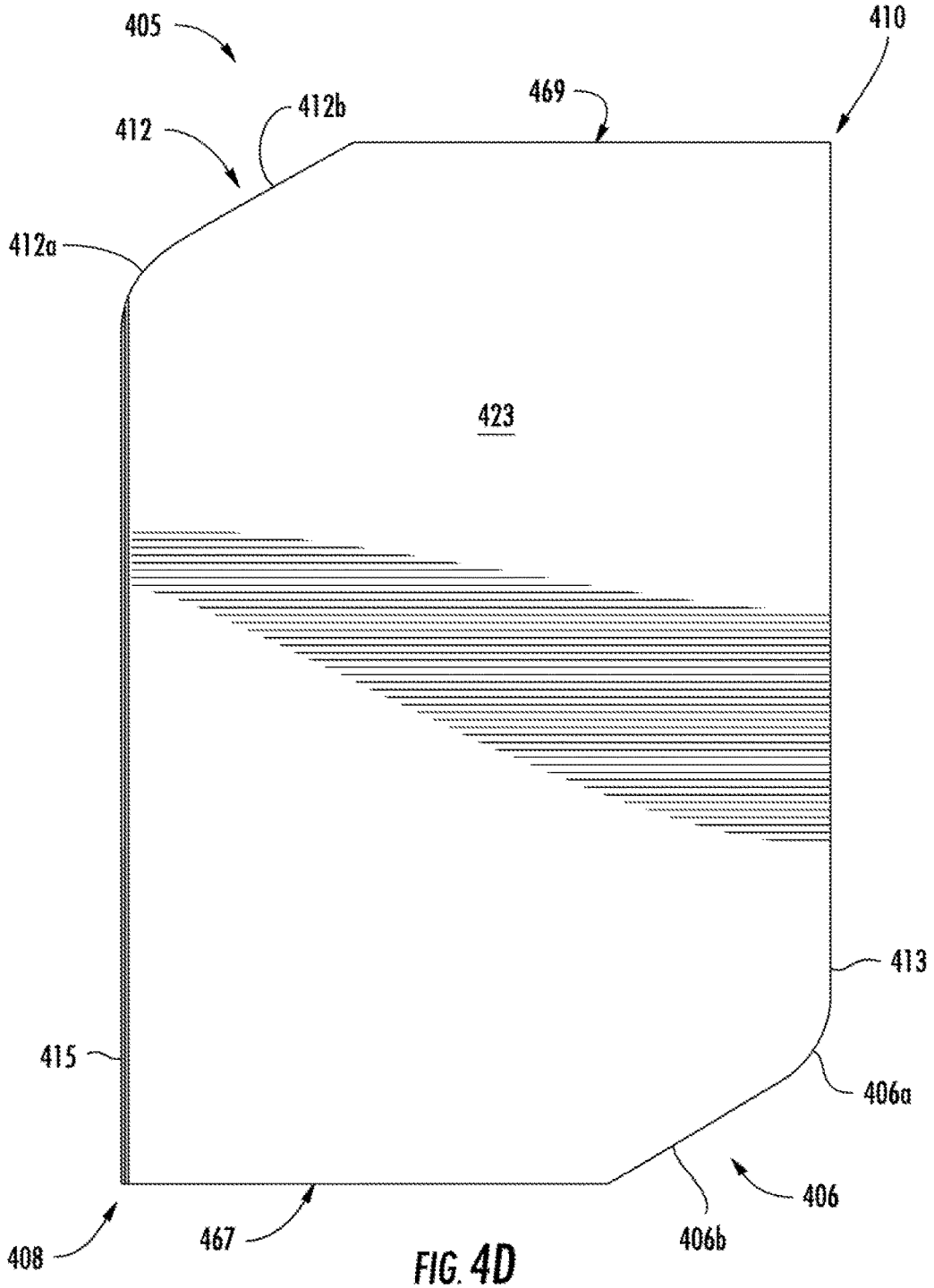
FIG. 4D is a top view of the carton of FIG. 4C.

With continued reference to FIG. 4A, and with additional reference to FIGS. 4C and 4D, each end 467, 469 includes one beveled or oblique corner 406, 412 having a rounded portion 406*a*, 412*a* and a beveled portion 406*b*, 412*b* and one square or orthogonal corner 408, 410. The edges 479 and 471 of the blank cooperate with the marginal end portion of the side panel 413 to form the corner 406 that has a rounded portion 406*a* corresponding to the curved edges 479*a*, 471*a* and an oblique or orthogonal portion 406*b* corresponding to the oblique fold lines 479*b*, 471*b*. The marginal portion of the side panel 413 is folded to conform to the curved edges 479*a*, 471*a* and the oblique edges 479*b*, 471*b* to form the rounded portion 406*a* and the orthogonal portion 406*b* of the corner 406. Similarly, the edges 477 and 473 of the blank 403 cooperate with the marginal portion of the side panel 415 to form the corner 412 that has a rounded portion 412*a* corresponding to the curved edges 477*a*, 473*a* and an oblique or orthogonal portion 412*b* corresponding to the oblique fold lines 477*b*, 473*b*. Square corners 408, 410 are respectively formed by the intersection of the fold lines associated with end flaps 449, 435, and 445, and 451, 443, and 437. The carton 405 could have other features or be otherwise shaped, arranged, and/or configured without departing from the disclosure.

Figure 4E:
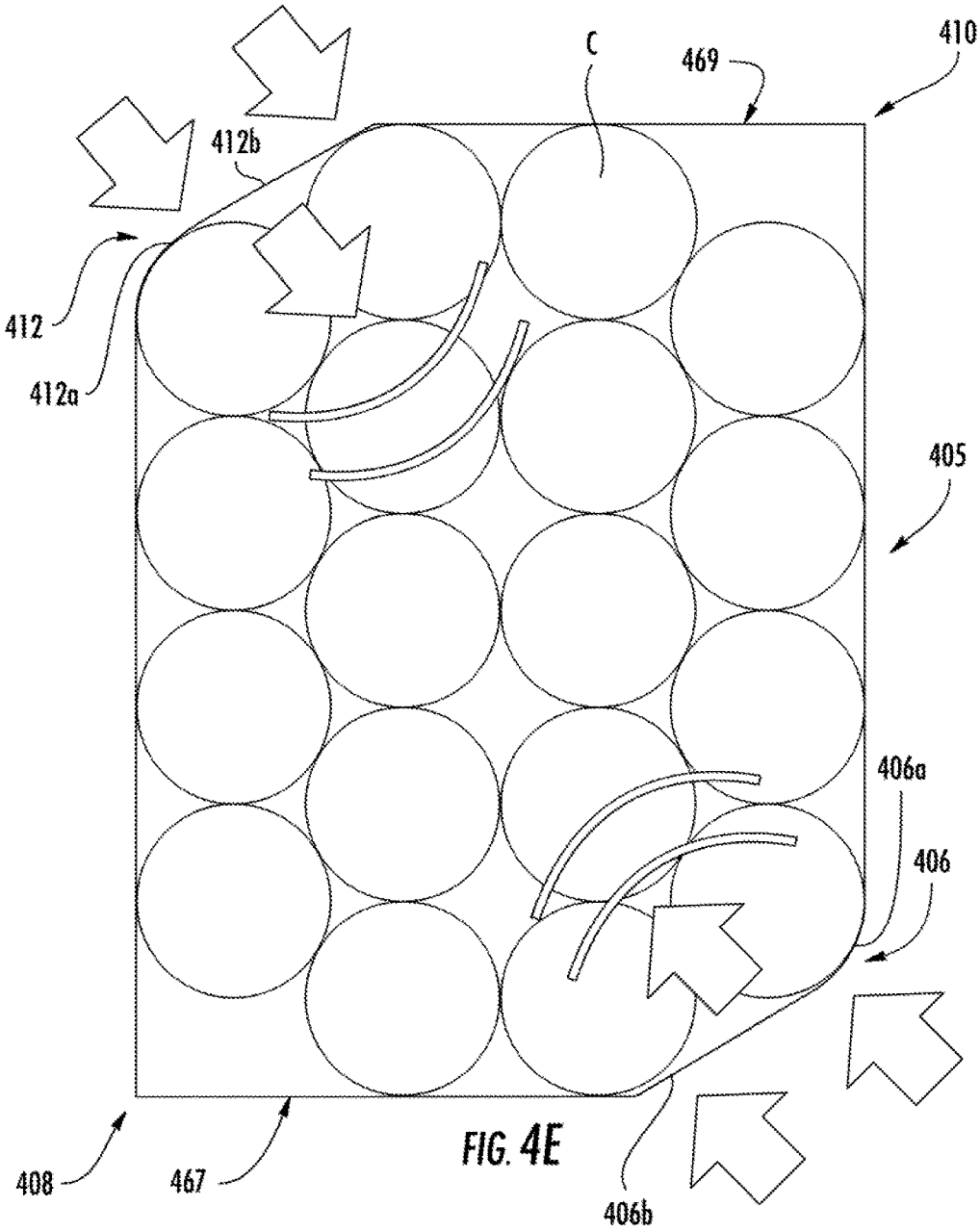
FIG. 4E is a schematic view of an interior of the carton of FIG. 4C showing the position of a plurality of containers disposed therein.

The asymmetrical corners 406, 408 and 410, 412 at each end allow the carton 405 to have more tightly packed containers to tighten the pack by pushing inward at the rounded-oblique corners 406, 412 (FIG. 4E). In this regard, the presence of rounded-oblique corners 406, 412 reduces what would otherwise be empty interior space at a square or orthogonal corner of a carton. At the same time, the presence of square or orthogonal corners 408, 410 at diagonally opposite positions along the carton 405 allows a degree of movement of articles C such that articles C can be more tightly packed into carton 405 than into a carton having uniform square or orthogonal corners, but while still providing clearance among the articles C, for example, to permit a degree of shifting and/or redistribution during shipping or other movement.

Additionally, indicia or other visual configurations of the exterior of carton 405 may be arranged differently on or near rounded-oblique corners 406, 412 and square or orthogonal corners 408, 410 so that indicia or other visual configurations of the carton 405 appear differently based on the consumer's point of view. For example, the presence of asymmetrical corners 406, 408 and 410, 412 in the described configuration yields a carton 405 with corners that, when viewed in sequence around the perimeter of carton 405, have alternating configurations, e.g., starting with corner 406 and proceeding along first side panel 413, a consumer would view a rounded-oblique corner (406), a square or orthogonal corner (410), a diamond corner (412), and a square or orthogonal corner (408). Such an alternating configuration may provide a break or disruption in visual perception on the part of the consumer that presents an enhanced opportunity to display indicia disposed on an exterior surface of the carton 405. As another example, when multiple cartons 405 are arranged and/or stacked near each other, the alternating configuration of corners 412, 408, 406, 410 as described above may sufficiently minimize visual uniformity of the cartons 405 to entice and/or allow additional viewing of the surface area of one or more cartons 405 by the user.

Various other asymmetrical corner combinations are within the scope of this disclosure, for example, a carton including rounded corners and beveled or oblique corners at respective ends of the carton.

Any of the features of the various embodiments of the disclosure can be combined with, replaced by, or otherwise configured with other features of other embodiments of the disclosure without departing from the scope of this disclosure. For example, additional or different handle features than those disclosed may be used with blanks and cartons according to exemplary embodiments of the present disclosure.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above. The blanks can also be laminated to or coated with one or more sheet-like materials at selected panels or panel sections.

The above embodiments may be described as having one or more panels adhered together by glue. The term "glue" is intended to encompass all manner of adhesives commonly used to secure carton panels or flaps in place.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, comprising:

a plurality of panels that extends at least partially around an interior of the carton, the plurality of panels comprising a bottom panel, a first side panel, a second side panel, and a top panel;

a plurality of end flaps respectively foldably connected to respective panels of the plurality of panels, the plurality of end flaps comprises a first plurality of end flaps that is at least partially overlapped to form a first closed end of the carton and the plurality of end flaps comprises a second plurality of end flaps that is at least partially overlapped to form a second closed end of the carton opposite the first closed end of the carton, the first plurality of end flaps comprises a first side end flap foldably connected to the first side panel and a second side end flap foldably connected to the second side panel, the second plurality of end flaps comprises a third side end flap foldably connected to the first side panel and a fourth side end flap foldably connected to the second side panel;

the first closed end comprises a first corner adjacent the first side panel and a second corner adjacent the second side panel, the first corner having a first shape and the second corner having a second shape, the first shape is different than the second shape, such that the first corner and the second corner are asymmetrical, the second closed end comprises a third corner adjacent the first side panel and a fourth corner adjacent the second side panel, the third corner having a third shape and the fourth corner having a fourth shape, the third shape is different than the fourth shape such that the third corner and the fourth corner are asymmetrical, the first shape and the fourth shape are the same.

2. The carton of claim 1, wherein the first shape is selected from the group consisting of curved, beveled, rounded, diamond, partially rounded and partially beveled, and orthogonal.

3. The carton of claim 2, wherein the second shape is selected from the group consisting of curved, beveled, rounded, diamond, partially rounded and partially beveled, and orthogonal.

4. The carton of claim 1, wherein the first side end flap forms the first corner and the second side end flap forms the second corner.

5. The carton of claim 4, wherein the top panel comprises a first edge and the bottom panel comprises a second edge, the first side end flap is folded to conform to the first edge and the second edge to form the first corner.

6. The carton of claim 5, wherein the first edge and the second edge are curved and the first corner is curved and extends from the first edge to the second edge.

7. The carton of claim 5, wherein the first edge and the second edge are straight and the first corner is beveled and extends from the first edge to the second edge.

8. The carton of claim 5, wherein the first edge and the second edge each comprise a fold line and a curved edge adjacent the fold line.

9. The carton of claim 8, wherein the carton comprises a first gusset at the first corner and extending between the top panel and the first side panel and a second gusset at the first corner and extending between the bottom panel and the first side panel.

10. The carton of claim 9, wherein each of the first gusset and the second gusset comprises a first gusset panel and a second gusset panel foldably connected to the first gusset panel, the second gusset panel of the first gusset being foldably connected to the top panel at the fold line of the first edge and the second gusset panel of the second gusset being foldably connected to the bottom panel at the fold line of the second edge.

11. The carton of claim 1, wherein the plurality of panels comprises a diamond corner panel foldably connected to the first side panel and the first side end flap, the first corner comprises the diamond corner panel, the second corner comprises the second side end flap that is folded orthogonally relative to the second side panel to form the second corner.

12. The carton of claim 1, wherein the second shape and the third shape are the same.

13. The carton of claim 1, wherein the first corner and the fourth corner are on diagonally opposite portions of the carton.

14. The carton of claim 13, wherein the second corner and the third corner are on diagonally opposite portions of the carton.

15. A blank for forming a carton for holding a plurality of containers, the blank comprising:

a plurality of panels comprising a bottom panel, a first side panel, a second side panel, and a top panel;

a plurality of end flaps respectively foldably connected to respective panels of the plurality of panels, the plurality of end flaps comprises a first plurality of end flaps for being at least partially overlapped to form a first closed end of the carton formed from the blank and the plurality of end flaps comprises a second plurality of end flaps for being at least partially overlapped to form a second closed end opposite the first closed end of the carton formed from the blank, the first plurality of end flaps comprises a first side end flap foldably connected to the first side panel and a second side end flap foldably connected to the second side panel, the second plurality of end flaps comprises a third side end flap foldably connected to the first side panel and a fourth side end flap foldably connected to the second side panel;

first corner features for forming a first corner adjacent first side panel at the first closed end and second corner features for forming a second corner adjacent the second side panel at the first closed end, the first corner having a first shape and the second corner having a second shape, the first shape is different than the second shape such that the first corner and the second corner are asymmetrical, third corner features for forming a third corner adjacent the first side panel at the second closed end and fourth corner features for forming a fourth corner adjacent the second side panel at the second closed end, the third corner having a third shape and the fourth corner having a fourth shape, the third shape is different than the fourth shape such that the third corner and the fourth corner are asymmetrical, the first shape and the fourth shape are the same.

16. The blank of claim 15, wherein the first shape is selected from the group consisting of curved, beveled, rounded, diamond, partially rounded and partially beveled, and orthogonal.

17. The blank of claim 16, wherein the second shape is selected from the group consisting of curved, beveled, rounded, diamond, partially rounded and partially beveled, and orthogonal.

18. The blank of claim 15, wherein the first corner features comprise the first side end flap that is for forming the first corner and the second corner features comprise the second side end flap that is for forming the second corner.

19. The blank of claim 18, wherein the top panel comprises a first edge and the bottom panel comprises a second edge, the first side end flap is folded to conform to the first edge and the second edge to form the first corner of the carton formed from the blank.

20. The blank of claim 19, wherein the first edge and the second edge are curved and the first corner is curved and extends from the first edge to the second edge in the carton formed from the blank.

21. The blank of claim 19, wherein the first edge and the second edge are straight and the first corner is beveled and extends from the first edge to the second edge in the carton formed from the blank.

22. The blank of claim 19, wherein the first edge and the second edge each comprise a fold line and a curved edge adjacent the fold line.

23. The blank of claim 22, wherein the first corner features comprise a first gusset extending between the top panel and the first side panel and a second gusset extending between the bottom panel and the first side panel.

24. The blank of claim 23, wherein each of the first gusset and the second gusset comprises a first gusset panel and a second gusset panel foldably connected to the first gusset panel, the second gusset panel of the first gusset being foldably connected to the top panel at the fold line of the first edge and the second gusset panel of the second gusset being foldably connected to the bottom panel at the fold line of the second edge.

25. The blank of claim 15, wherein the plurality of panels comprises a diamond corner panel foldably connected to the first side panel and the first side end flap, the first corner features comprise the diamond corner panel, the second corner features comprise the second side end flap that is folded orthogonally relative to the second side panel to form the second corner.

26. The blank of claim 15, wherein the second shape and the third shape are the same.

27. The blank of claim 15, wherein the first corner and the fourth corner are on diagonally opposite portions of the carton formed from the blank.

28. The blank of claim 27, wherein the second corner and the third corner are on diagonally opposite portions of the carton formed from the blank.

29. A method of forming a carton for holding a plurality of articles, the method comprising:

obtaining a blank having a plurality of panels comprising a bottom panel, a first side panel, a second side panel, and a top panel, a plurality of end flaps respectively foldably connected to respective panels of the plurality of panels, the plurality of end flaps comprises a first plurality of end flaps comprising a first side end flap foldably connected to the first side panel and a second side end flap foldably connected to the second side panel, the plurality of end flaps comprises a second plurality of end flaps comprising a third side end flap foldably connected to the first side panel and a fourth side end flap foldably connected to the second side panel, first corner features, second corner features, third corner features, and fourth corner features;

closing a first end of the carton by at least partially overlapping the first plurality of end flaps to form the first closed end of the carton, the closing the first end comprises forming the first corner by positioning the first corner features of the blank, the first corner being adjacent the first side panel at the first closed end, and forming the second corner by positioning the second corner features of the blank, the second corner features being adjacent the second side panel at the first closed end, closing a second end of the carton by at least partially overlapping the second plurality of end flaps to form the second closed end of the carton opposite the first closed end of the carton, the closing the second end comprises forming the third corner by positioning the third corner features of the blank, the third corner being adjacent the first side panel at the second closed end, and forming the fourth corner by positioning the fourth corner features of the blank, the fourth corner being adjacent the second side panel at the second closed end, the first corner having a first shape and the second corner having a second shape, the first shape is different than the second shape such that the first corner and the second corner are asymmetrical, the third corner having a third shape and the fourth corner having a fourth shape, the third shape is different than the fourth shape such that the third corner and the fourth corner are asymmetrical, the first shape and the fourth shape are the same.

30. The method of claim 29, wherein the first shape is selected from the group consisting of curved, beveled, rounded, diamond, partially rounded and partially beveled, and orthogonal.

31. The method of claim 30, wherein the second shape is selected from the group consisting of curved, beveled, rounded, diamond, partially rounded and partially beveled, and orthogonal.

32. The method of claim 29, wherein the forming the first corner comprises positioning the first side end flap and the forming the second corner comprises positioning the second side end flap.

33. The method of claim 32, wherein the top panel comprises a first edge and the bottom panel comprises a second edge, the forming the first corner comprises folding the first side end flap to conform to the first edge and the second edge to form the first corner.

34. The method of claim 33, wherein the first edge and the second edge are curved and at least a portion of the first side end flap is curved to form the first corner that extends from the first edge to the second edge.

35. The method of claim 33, wherein the first edge and the second edge are straight and at least a portion of the first side end flap is beveled to from the first corner that extends from the first edge to the second edge.

36. The method of claim 33, wherein the first edge and the second edge each comprise a fold line and a curved edge adjacent the fold line.

37. The method of claim 36, wherein the blank comprises a first gusset extending between the top panel and the first side panel and a second gusset extending between the bottom panel and the first side panel, the forming the first corner comprises positioning the first gusset and the second gusset.

38. The method of claim 37, wherein each of the first gusset and the second gusset comprises a first gusset panel and a second gusset panel foldably connected to the first gusset panel, the second gusset panel of the first gusset being foldably connected to the top panel at the fold line of the first edge and the second gusset panel of the second gusset being foldably connected to the bottom panel at the fold line of the second edge.

39. The method of claim 29, wherein the plurality of panels comprises a diamond corner panel foldably connected to the first side panel and the first side end flap, the first corner features comprise the diamond corner panel, the second corner features comprise the second side end flap, the forming the first corner comprises positioning the diamond corner panel relative to the first side panel and the first side end flap and the forming the second corner comprises folding the second side end flap orthogonally relative to the second side panel.

40. The method of claim 29, wherein the second shape and the third shape are the same.

41. The method of claim 29, wherein the first corner and the fourth corner are on diagonally opposite portions of the carton.

42. The method of claim 41, wherein the second corner and the third corner are on diagonally opposite portions of the carton.

* * * * *